US008361686B2

(12) United States Patent
Nukada et al.

(10) Patent No.: US 8,361,686 B2
(45) Date of Patent: Jan. 29, 2013

(54) ELECTROPHOTOGRAPHIC PHOTORECEPTOR, PROCESS CARTRIDGE AND IMAGE FORMING APPARATUS

(75) Inventors: Hidemi Nukada, Kanagawa (JP); Shinya Yamamoto, Kanagawa (JP); Masaru Miura, Kanagawa (JP); Hitoshi Takimoto, Kanagawa (JP); Takahiro Suzuki, Kanagawa (JP); Tetsunao Koujiri, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 942 days.

(21) Appl. No.: 12/246,912

(22) Filed: Oct. 7, 2008

(65) Prior Publication Data

US 2009/0226208 A1 Sep. 10, 2009

(30) Foreign Application Priority Data

Mar. 5, 2008 (JP) ..... 2008-055467

(51) Int. Cl.
*G03G 9/00* (2006.01)

(52) U.S. Cl. ..... 430/66; 430/62; 430/63; 430/64; 430/65; 399/111

(58) Field of Classification Search ..... 430/62–66, 430/58.05; 399/111
See application file for complete search history.

(56) References Cited

U.S. PATENT DOCUMENTS 4,792,507 A 12/1988 Yoshihara et al.
(Continued)

FOREIGN PATENT DOCUMENTS

CN 1091468 A 10/1994
(Continued)

OTHER PUBLICATIONS english translation of JP 2000275889 A, Oct. 2000, kashigawa.*
(Continued)

*Primary Examiner* — Mark F Huff
*Assistant Examiner* — Rashid Alam
(74) *Attorney, Agent, or Firm* — Oliff & Berridge, PLC

(57) ABSTRACT

An electrophotographic photoreceptor comprising at least a photosensitive layer on an electroconductive substrate, a surface layer of the electrophotographic photoreceptor including a fluorinated alkyl group-containing copolymer having repeating units represented by the following formulae A and B, and fluorine-based resin particles:

Formula A

Formula B wherein in Formulae A and B, l, m and n each independently represent a integer number of 1 or more; p, q, r and s each independently represent 0 or an integer of 1 or more; t represents an integer of from 1 to 7; $R_1$, $R_2$, $R_3$, and $R_4$ each independently represent a hydrogen atom or an alkyl group; X represents an alkylene chain, a halogen-substituted alkylene chain, —S—, —O—, —NH— or a single bond; Y represents an alkylene chain, a halogen-substituted alkylene chain, —($C_zH_{2z-1}$(OH))— or a single bond; and z represents an integer of 1 or more.

17 Claims, 3 Drawing Sheets

U.S. PATENT DOCUMENTS

| | | | | |
|---|---|---|---|---|
| 5,357,320 | A | 10/1994 | Kashimura et al. | |
| 5,485,250 | A | 1/1996 | Kashimura et al. | |
| 6,030,736 | A | 2/2000 | Ikegami et al. | |
| 6,664,014 | B1 | 12/2003 | Kikuchi et al. | |
| 2005/0026058 | A1 | 2/2005 | Kami et al. | |
| 2007/0292780 | A1 * | 12/2007 | Nagai et al. | 430/58.2 |
| 2010/0221652 | A1 | 9/2010 | Nukada et al. | |

FOREIGN PATENT DOCUMENTS

| | | | |
|---|---|---|---|
| CN | 1094168 | A | 10/1994 |
| CN | 1196506 | | 10/1998 |
| JP | A-63-221355 | | 9/1988 |
| JP | A-6-208239 | | 7/1994 |
| JP | A-06-230591 | | 8/1994 |
| JP | A-06-332217 | | 12/1994 |
| JP | A-10-97122 | | 4/1998 |
| JP | 2000275889 | A * | 10/2000 |
| JP | A-2000-275889 | | 10/2000 |
| JP | A-2005-062830 | | 3/2005 |
| JP | A-2006-184745 | | 7/2008 |

OTHER PUBLICATIONS

Notice of Reasons for Rejection dated Dec. 14, 2010 in Japanese Patent Application No. 2009-046193 (with translation).

U.S. Office Action dated Dec. 22, 2011 in U.S. Appl. No. 12/569,304.

U.S. Appl. No. 12/569,304, filed Sep. 29, 2009 in the name of Nukuda et al.

Jun. 4, 2012 Office Action issued in U.S. Appl. No. 12/569,304.

* cited by examiner

ELECTROPHOTOGRAPHIC PHOTORECEPTOR, PROCESS CARTRIDGE AND IMAGE FORMING APPARATUS

CROSS-REFERENCE TO RELATED APPLICATION

This application is based on and claims priority under 35 USC 119 from Japanese Patent Application No. 2008-055467 filed Mar. 5, 2008.

BACKGROUND

1. Technical Field

The present invention relates to an electrophotographic photoreceptor, a process cartridge and an image forming apparatus.

2. Related Art

Image formation by an electrophotographic system is widely used in the fields of copying machines, laser beam printers, and the like, since this technique has such advantages as high speed and high quality printing. As an electrophotographic photoreceptor used in an image forming apparatus (hereinafter sometimes simply referred to as a "photoreceptor"), electrophotographic photoreceptors employing an organic photoconductive material, having such advantages as low cost, high productivity and disposability, have become the mainstream of electrophotographic photoreceptors, as compared with electrophotographic photoreceptors employing an inorganic photoconductive material. In particular, function-separate type organic photoreceptors, having a charge generation layer that generates charges upon exposure to light and a charge transport layer that transports the charges, exhibit excellent electrophotographic characteristics, and therefore, various proposals have been made for such function-separate type organic photoreceptors, putting them to practical use.

Incidentally, organic photoreceptors, which are generally inferior to inorganic photoreceptor in mechanical strength, are prone to being subjected to scratches or wear upon application of an external mechanical force by a cleaning blade, a developing brush, a recording medium or the like, and therefore have a short operating life. Further, in a system employing a contact charging system which has come into use in recent years from the viewpoint of ecological concerns, there is a problem in that the amount of wear of the photoreceptor is significantly increased, as compared with photoreceptors employing a non-contact charging system using a corotoron. Such insufficient durability of a photoreceptor may become a cause of decrease in image density due to reduced sensitivity, occurrence of fogging in an image due to a reduced charge potential, or the like.

In order to avoid the above-mentioned phenomena, methods of improving durability of a photosensitive layer have been studied. For example, a method of reducing a surface energy of a surface layer of a photoreceptor by dispersing fluorine-based resin particles in the surface layer has been proposed.

Since fluorine-based resin particles have a low dispersibility and a high cohesive force, the fluorine-based resin particles contained in a surface layer of an electrophotographic photoreceptor tend to be unevenly distributed in the surface layer. Consequently, there is a problem in that it may be difficult to obtain a favorable image in a stable manner, owing to abnormalities in image quality such as black spots, white spots, uneven density or the like caused by defects formed in a coated layer due to aggregation of the fluorine-based resin particles.

SUMMARY

According to an aspect of the invention, there is provided an electrophotographic photoreceptor comprising at least a photosensitive layer on an electroconductive substrate, a surface layer of the electrophotographic photoreceptor including a fluorinated alkyl group-containing copolymer having repeating units represented by the following Formulae A and B, and fluorine-based resin particles:

Formula A

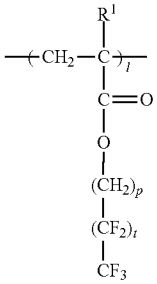

Formula B

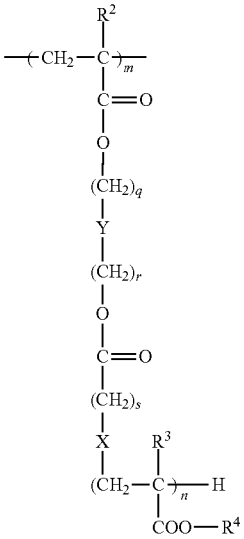

wherein in Formulae A and B, l, m and n each independently represent a integer number of 1 or more; p, q, r and s each independently represent 0 or an integer of 1 or more; t represents an integer of from 1 to 7; $R_1$, $R_2$, $R_3$, and $R_4$ each independently represent a hydrogen atom or an alkyl group; X represents an alkylene chain, a halogen-substituted alkylene chain, —S—, —O—, —NH— or a single bond; Y represents an alkylene chain, a halogen-substituted alkylene chain, —($C_zH_{2z-1}$(OH))— or a single bond; and z represents an integer of 1 or more.

BRIEF DESCRIPTION OF THE DRAWINGS

Exemplary embodiments of the present invention will be described in detail based on the following figures, wherein.

DETAILED DESCRIPTION

Figure 1:
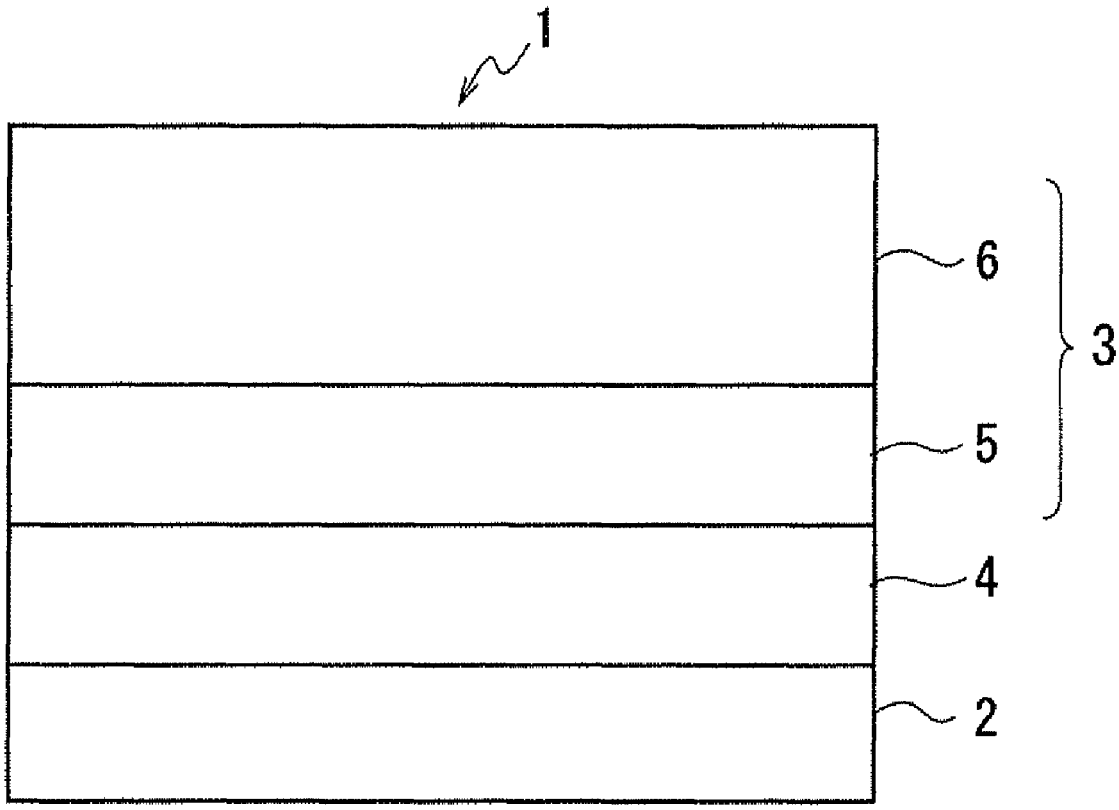
FIG. 1 is a cross-sectional view of an example of an electrophotographic photoreceptor according to an exemplary embodiment of the present invention.

Hereafter, exemplary embodiments of an electrophotographic photoreceptor, a process cartridge and an image forming apparatus of the present invention will be explained in detail.

Electrophotographic Photoreceptor

The electrophotographic photoreceptor of the present embodiment has at least a photosensitive layer on an electroconductive substrate, and a surface layer of the photoreceptor contains a fluorinated alkyl group-containing copolymer (hereinafter, sometimes referred to as a "copolymer of the present embodiment") containing repeating units represented by the following Formula A and the following Formula B, and fluorine-based resin particles.

Formula A

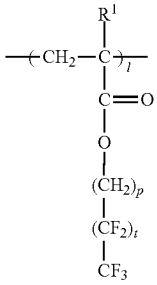

Formula B

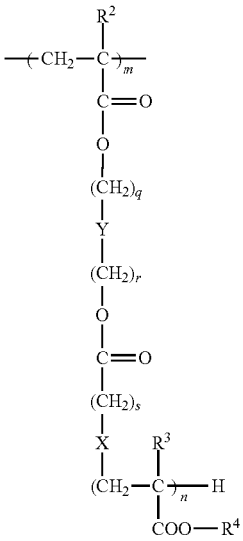

In Formula A and Formula B, l, m, and n each independently represent an integer of 1 or more; p, q, r, and s each independently represent 0 or an integer of 1 or more; t represents an integer of from 1 to 7; $R_1$, $R_2$, $R_3$, and $R_4$ each independently represent a hydrogen atom or an alkyl group; X represents an alkylene chain, a halogen-substituted alkylene chain, —S—, —O—, —NH—, or a single bond; Y represents an alkylene chain, a halogen-substituted alkylene chain, —($C_zH_{2z-1}$(OH))—, or a single bond; and z represents an integer of 1 or more.

In order to attain both of electrophotographic characteristics and durability of an electrophotographic photoreceptor at high levels, the inventors have made a study first on a surface layer containing fluorine-based resin particles and a fluorine-based graft polymer that serves as a dispersing aid for dispersing the fluorine-based resin particles. As a result, it was found that a phenomenon of decrease in density due to increase in residual potential was caused by the fluorine-based graft polymer that was present in the surface layer in a free state.

More specifically, the amount of addition of the fluorine-based graft polymer tends to exceed a requisite amount in many cases, and therefore, the excess amount of fluorine-based graft polymer, which is not adsorbed to the surface of the fluorine-based resin particles, exists in the surface layer in a free state. The fluorine-based graft polymer in a free state may serve as a substance that causes development of trap sites at which charges accumulate. As a result, decrease in density tends to occur due to an increased residual potential upon repetitive use of the photoreceptor at high temperature and high humidity. That is, even if the physical durability can be improved, stable electrophotographic characteristics cannot be achieved.

As a result of the study on the structure of fluorine-based graft polymers, the inventors have found a specific fluorine-based graft polymer which may improve and maintain dispersibility of the fluorine-based resin particles.

The copolymer according to the present embodiment includes repeating units represented by Formula A and Formula B, but when t in Formula A is less than 1, adsorptivity of the fluorine-based graft polymer to the fluorine-based resin particles may decrease to deteriorate the function thereof as a dispersing aid. When the dispersibility of the fluorine-based resin particles is low, it may be difficult to achieve sufficient durability of the electrophotographic photoreceptor due to uneven distribution of the fluorine-based resin particles in the surface layer.

Further, when t in Formula A is 8 or more, compatibility of the fluorine-based graft polymer with a binder resin contained in the surface layer may be deteriorated. As a result, the interface of the fluorine-based graft polymer and the binder resin may serve as trap sites, causing decrease in density due to increase in residual potential upon repepetive use at high temperature and high humidity.

On the other hand, if t in Formula A is from 1 to 7, the fluorine-based graft polymer may attain compatibility with the binder resin contained in the surface layer, while maintaining adsorptivity to the fluorine-based resin particles. The desirable range of t in Formula A is from 2 to 6.

The layer structure or the like of the electrophotographic photoreceptor of the present embodiment is not particularly limited, as long as the electrophotographic photoreceptor has at least a photosensitive layer on an electroconductive substrate, and the copolymer of the present embodiment and fluorine-based resin particles are contained in a surface layer of the photoreceptor The photosensitive layer of the present embodiment may be a function integrated photosensitive layer having both a charge transporting function and a charge generating function, or may be a function separated photosensitive layer having a charge transport layer and a charge generation layer. Further, if necessary, other layers such as an undercoat layer, an intermediate layer, a protective layer or the like may be provided to the photoreceptor.

In the electrophotographic photoreceptor of the present embodiment, when a function integrated photosensitive layer serves as a surface layer, the copolymer of the present embodiment and the fluorine-based resin particles are contained in the function integrated photosensitive layer. When one of a charge transport layer and a charge generation layer included in a function separated photosensitive layer serves as a surface layer, the copolymer of the present embodiment and fluorine-based resin particles are contained in the layer corresponding to the surface layer. Furthermore, when a protective layer is provided on a photosensitive layer as a surface layer, the copolymer of the present embodiment and fluorine-based resin particles are contained in the protective layer.

FIG. 1 is a cross-sectional view showing an example of the electrophotographic photoreceptor of the present embodiment. The electrophotographic photoreceptor 1 in FIG. 1 has a structure in which an undercoat layer 4, a charge generation layer 5, and a charge transport layer 6 are laminated on an conductive substrate 2 in this order, and the charge generation layer 5 and the charge transport layer 6 constitute a function separated photosensitive layer 3. In FIG. 1, the charge transport layer 6 serves as a surface layer (a layer positioned at an outermost side from the electroconductive substrate 2) in the electrophotographic photoreceptor 1. In the electrophotographic photoreceptor as shown in FIG. 1, the copolymer of the present embodiment and the fluorine-based resin particles are contained in the charge transport layer 6.

Hereafter, each element of the electrophotographic photoreceptor 1 will be explained.

Any conventionally used material may be used for an electroconductive substrate 2. Examples of such materials include metals such as aluminum, nickel, chromium, and stainless steel; plastic films provided with a thin layer of aluminum, titanium, nickel, chromium, stainless steel, gold, vanadium, tin oxide, indium oxide, ITO or the like; paper coated with or impregnated with an electroconductivity-imparting agent; and plastic films. The shape of the electroconductive substrate 2 is not limited to a drum, and may be a sheet a plate or the like.

When a metal pipe is used as the electroconductive substrate 2, the surface of the pipe may be in an untreated state, or may be subjected to a pre-treatment such as mirror surface cutting, etching, anodic oxidation, rough cutting, centerless grinding, sandblast and wet honing.

The undercoat layer 4 may be provided for the purpose of preventing light reflection at the surface of the electroconductive substrate 2, or preventing inflow of unnecessary careers from the electroconductive substrate 2 to the photosensitive layer 3, or the like, as necessary. The undercoat layer 4 may be prepared by coating a substrate with a composition containing a binder resin dispersing metal powder of aluminum, copper, nickel, silver or the like; an electroconductive metal oxide such as antimony oxide, indium oxide, tin oxide, or zinc oxide; or an electroconductive material such as carbon fiber, carbon black, or graphite powder. Further, two or more kinds of metal oxide particles may be mixed and used. Moreover, metal oxide particles may be subjected to a surface treatment with a coupling agent in order to control the powder resistance thereof.

The binder resins contained in the undercoat layer 4 may be known polymer resin compounds including an acetal resin such as polyvinyl butyral; a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and a urethane resin; charge transporting resins having a charge transporting group; and electroconductive resins such as polyaniline. Among them, resins that are insoluble in a solvent used for forming an upper layer are preferably used, and in particular, a phenolic resin, a phenol-formaldehyde resin, a melamine resin, a urethane resin, an epoxy resin, and the like are preferably used.

The ratio of the metal oxide particles to the binder resin in the undercoat layer 4 may be arbitrarily determined without being particularly limited, as long as desired characteristics of the electrophotographic photoreceptor can be obtained.

When forming the undercoat layer 4, a coating liquid prepared by adding the above-mentioned component to a predetermined solvent may be used. Such solvents include, for example, organic solvents such as aromatic hydrocarbons solvents such as toluene and chlorobenzene; aliphatic alcohol-based solvents such as methanol, ethanol, n-propanol, iso-propanol, n-butanol; ketone-based solvents such as acetone, cyclohexanone, and 2-butanone; halogenated aliphatic hydrocarbon solvents such as methylene chloride, chloroform and ethylene chloride; cyclic or straight-chained ether-based solvents such as tetrahydrofuran, dioxane, ethylene glycol, and diethyl ether; and ester-based solvents such as methyl acetate, ethyl acetate and n-butyl acetate. These solvents may be used singly or in combination of two or more kinds. When two or more kinds of solvents are used in combination, any solvents may be used as long as the binder resin can be dissolved therein.

Further, as a means of dispersing metal oxide particles in a coating liquid for forming an undercoat layer, media dispersing machines such as a ball mill, a vibration ball mill, an attritor, a sand mill and a lateral sand mill; medialess dispersing machines such as an agitator, an ultrasonic dispersing machine, a roll mill, and a high-pressure homogenizer, can be used. Furthermore, the high-pressure homogenizer includes a collision type homogenizer in which a dispersion liquid is dispersed under high pressure by liquid-liquid collision or liquid-wall collision; and a passing-through type homogenizer in which a dispersion liquid is dispersed by passing the dispersion liquid through thin flow paths under high pressure.

Methods of applying the thus obtained coating liquid for forming the undercoat layer onto the electroconductive substrate 1 include a dip coating method, an extrusion coating method, a wire bar coating method, a spray coating method, a blade coating method, a knife coating method, a curtain coating method, and the like. The thickness of the undercoat layer 4 is preferably 15 μm or more, and more preferably from 20 μm to 50 μm. Resin particles may also be added to the undercoat layer 4, in order to adjust the surface roughness of the undercoat layer. As the resin particles, silicone resin particles, crosslinked-type PMMA resin particles, and the like can be used.

Further, the surface of the undercoat layer 4 may be ground for adjusting the surface roughness. As the grinding method, a buff polishing, a sandblast treatment, a wet honing, a grinding treatment and the like may be used.

Furthermore, although not illustrated in the drawings, an intermediate layer may be provided on the undercoat layer 4 in order to improve electrical properties, image quality, image quality maintainability, adhesion to a photosensitive layer, and the like. Binder resins used for the intermediate layer include, in addition to polymer resin compounds such as an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, and a melamine resin; organic metal compounds containing zirconium atoms, titanium atoms, aluminum atoms, manganese atoms, silicon atoms or the like. These compounds can be used singly, or as a mixture or polycondensation product of plural compounds. Among them, organic metal compounds containing zirconium or silicon exhibit excellent characteristics such as a low residual potential, a low potential fluctuation due to environment, and a small change in potential due to repetitive use.

Solvents used for forming the intermediate layer include known organic solvents, for example, aromatic hydrocarbon solvents such as toluene and chlorobenzene; aliphatic alcohol-based solvents such as methanol, ethanol, n-propanol, iso-propanol and n-butanol; ketone-based solvents such as acetone, cyclohexanone, and 2-butanone; halogenated aliphatic hydrocarbon solvents such as methylene chloride, chloroform and ethylene chloride; cyclic or straight-chained ether-based solvents such as tetrahydrofuran, dioxane, ethylene glycol, and diethyl ether; ester-based solvents such as methyl acetate, ethyl acetate and n-butyl acetate. These solvents can be used singly or in combination of two or more kinds. When two or more kinds of solvents are used, any solvents may be used as long as the mixture of the solvents can dissolve the binder resin.

Coating methods for forming the intermediate layer include common methods such as a dip coating method, an extrusion coating method, a wire bar coating method, a spray coating method, a blade coating method, a knife coating method, a curtain coating method, and the like.

The intermediate layer serves also as an electric blocking layer, in addition to serving to improve a coating property of a layer formed thereon. However, when the thickness of the intermediate layer is too large, an electric hindrance may become too strong to cause desensitization or increase in an electric potential due to repetitive use. Accordingly, when forming the intermediate layer, the thickness thereof is preferably in the range of from 0.1 μm to 3 μm. Further, in this case, the intermediate layer may also serve as the undercoat layer 4.

The charge generation layer 5 is formed by dispersing a charge generating material in an appropriate binder resin. Examples of such a charge generating material include phthalocyanine pigments such as non-metal phthalocyanine, chlorogallium phthalocyanine, hydroxygallium phthalocyanine, dichloro tinphthalocyanine, titanyl phthalocyanine, and the like. In particular, chlorogallium phthalocyanine crystals having strong diffraction peaks at least at 7.4°, 16.6°, 25.5° and 28.3° of Bragg angles (2θ±0.2°) with respect to CuKα characteristic X rays; non-metal phthalocyanine crystals having strong diffraction peaks at least at 7.7°, 9.3°, 16.9°, 17.5°, 22.4° and 28.8° of Bragg angles (2θ+0.2°) with respect to CuKα characteristic X rays; hydroxygallium phthalocyanine crystals having strong diffraction peaks at least at 7.5°, 9.9°, 12,5°, 16.3°, 18.6°, 25.1° and 28.3° of Bragg angles (2θ±0.2°) with respect to CuKα characteristic X rays; and titanyl phthalocyanine crystals having strong diffraction peaks at least at 9.6°, 24.1° and 27.2° of Bragg angles (2θ±0.2°) with respect to CuKα characteristic X rays, may be used. In addition, other charge generating materials such as a quinone pigment, a perylene pigment, an indigo pigment, a bisbenzoimidazole pigment, an anthrone pigment, a quinacridone pigment, and the like, may also be used. These charge generating materials may be used singly or in combination of two or more kinds.

The binder resins used in the charge generation layer 5 include, for example, polycarbonate resins of bisphenol A-type, bisphenol Z-type or the like, an acrylic resin, a methacrylic resin, a polyallylate resin, a polyester resin, a polyvinyl chloride resin, a polystyrene resin, an acrylonitrile-styrene copolymer resin, an acrylonitrile-butadiene copolymer, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, a poly-N-vinylcarbazole resin, and the like. These binder resins may be used singly or in combination of two or more kinds. The compounding ratio of the charge generating material and the binder resin is preferably in the range of from 10:1 to 1:10.

The charge generation layer 5 is formed by applying a coating liquid in which the aforementioned components are added to a predetermined solvent. Examples of the solvent include organic solvents such as aromatic hydrocarbon solvents such as toluene and chlorobenzene; aliphatic alcohol-based solvents such as methanol, ethanol, n-propanol, iso-propanol and n-butanol; ketone-based solvents such as acetone, cyclohexanone, and 2-butanone; halogenated aliphatic hydrocarbon solvents such as methylene chloride, chloroform and ethylene chloride; cyclic or straight-chained ether-based solvents such as tetrahydrofuran, dioxane, ethylene glycol, and diethyl ether; and ester-based solvents such as methyl acetate, ethyl acetate and n-butyl acetate. These solvents may be used singly or in combination of two or more kinds. When two or more kinds of solvents are used, any solvents may be used as long as the mixture of the solvents can dissolve the binder resin.

In order to disperse a charge generating material in a resin, a coating liquid is subjected to a dispersing treatment. As a means of dispersing, media dispersing machines such as a ball mill, a vibration ball mill, an attritor, a sand mill and a lateral sand mill, and medialess dispersing machines such as an agitator, an ultrasonic dispersing machine, a roll mill, and a high-pressure homogenizer, can be used. Further, the high-pressure homogenizer includes a collision-type homogenizer in which a dispersion liquid is dispersed by liquid-liquid collision, or liquid-wall collision under high pressure, or a passing through-type homogenizer in which a dispersion liquid is dispersed by passing the dispersion liquid through thin flow paths under high pressure.

Methods of applying the thus obtained coating liquid onto the undercoat layer 4 include a dip coating method, an extrusion coating method, a wire bar coating method, a spray coating method, a blade coating method, a knife coating method, a curtain coating method, and the like. The thickness of the charge generation layer 5 is preferably in the range of from 0.01 μm to 5 μm, and more preferably from 0.05 μm to 2.0 μm.

The charge transport layer 6 corresponds to the surface layer of the electrophotographic photoreceptor 1, and contains the copolymer of the present embodiment and fluorine-based resin particles as described above.

The copolymer of the present embodiment is a fluorine-based graft polymer including repeating units represented by Formula A and Formula B, which is a resin synthesized by, for example, graft polymerization using a macro monomer comprised of an acrylic acid ester compound, a methacrylic acid ester compound or the like, and a perfluoroalkyl ethyl (meth) acrylate, a perfluoroalkyl (meth)acrylate, or the like. Here, the term "(meth)acrylate" refers to either an acrylate or a methacrylate.

The weight average molecular weight of the copolymer of the present embodiment is preferably from 10,000 or about 10,000 to 100,000 or about 100,000, and more preferably from 30,000 to 100,000. When the weight average molecular weight is 10,000 or more, or about 10,000 or more, the fluorine-based resin particles may exhibit excellent dispersion stability in the surface layer. On the other hand, when the weight average molecular weight is 100,000 or less, or about 100,000 or less, excellent compatibility of the copolymer with the binder resin may be achieved, preventing the interface between the copolymer of the present embodiment and the binder resin from serving as trap sites for electric charges. As a result, increase in the residual potential may be suppressed even when the photoreceptor is used in a repeated manner at high temperature and high humidity.

Method of Measuring Molecular Weight

The weight average molecular weight in the present embodiment refers to a value measured by the following method.

In the measurement, an apparatus "HLC-8120GPC, SC-8020" (trade name, manufactured by Tosoh Corporation) is used as gel permeation chromatography (GPC), two of "TSKgel, Super HM-H" (trade name, manufactured by Tosoh Corporation, 6.0 mm ID×15 cm) are used as the column, and THF (tetrahydrofuran) is used as an eluent. Experiment is conducted under the experimental conditions of sample concentration: 0.5%, flow rate: 0.6 ml/min, sample injection amount: 10 μl, and measurement temperature: 40° C., using an IR detector. The calibration curve is produced from nine samples of "A-1000", "A-2500", "A-5000", "F-1", "F-2", "F-4", "F-10", "F-40", and "F-80" from "Polystyrene Reference Sample TSK Standard" (manufactured by Tosoh Corporation).

In the copolymer of the present embodiment, the content ratio of Formula A and Formula B, i.e., the ratio of 1:m, is preferably from 1:9 to 9:1, and more preferably from 3:7 to 7:3. When the ratio 1:m is in the range of from 3:7 to 7:3, fluorine-based resin particles can be favorably dispersed.

In Formula A and Formula B, Examples of an alkyl group represented by $R_1$, $R_2$, $R_3$ and $R_4$ include a methyl group, an ethyl group, a propyl group and the like. $R_1$, $R_2$, $R_3$ and $R_4$ are preferably a hydrogen atom or a methyl group, and more preferably a methyl group.

The copolymer of the present embodiment may further contain a repeating unit represented by Formula C, as necessary. The content of Formula C with respect to the total content of Formula A and Formula B, i.e., the ratio of 1+m:y, is preferably from 10:0 to 7:3, and more preferably from 9:1 to 7:3.

Formula C

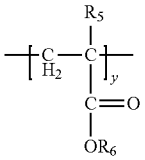

In Formula C, $R_5$ and $R_6$ each independently represent an alkyl group, and y is an integer of 1 or more. Example of the alkyl group represented by $R_5$ and $R_6$ include a methyl group, an ethyl group, a propyl group and the like. $R_5$ and $R_6$ are preferably a hydrogen atom or a methyl group, and more preferably a methyl group.

The content of the copolymer of the present embodiment in the surface layer, i.e., a charge transport layer 6, is preferably from 1% by weight to 5% by weight with respect to the content of the fluorine-based resin particles in the surface layer. When the content of the copolymer of the present embodiment is 1% by weight or more, the fluorine-based resin particles may be uniformly dispersed in the charge transport layer 6. When the content of the copolymer of the present embodiment is 5% by weight or less, the amount of the copolymer of the present embodiment which is not adsorbed to the surface of the fluorine-based resin particles may be reduced in the charge transport layer 6, thereby suppressing generation of trap sites for electric charges caused by the presence of the copolymer of the present embodiment in a free state. As a result, an electrophotographic photoreceptor can be obtained in which increase in the residual potential and decrease in density are suppressed even upon repetitive use at high temperature and high humidity.

The content of the fluorine-based resin particles with respect to the total solid content of the surface layer, i.e., the charge transport layer 6, is preferably from 1% by weight, or about 1% by weight, to 15% by weight, or about 15% by weight, and more preferably from 1% by weight to 12% by weight. When the content of the fluorine-based resin particles is 1% by weight or more, or about 1% by weight or more, the surface energy of the charge transport layer 6 may be lowered and durability of the electrophotographic photoreceptor may be improved. When the content of the fluorine-based resin particles is 15% by weight or less, or about 15% by weight or less, decrease in light transmittance and strength of the layer may be suppressed.

The fluorine-based-resin particles is preferably at least one selected from a tetrafluoroethylene resin (PTFE), a trifluoroethylenechloride resin, a hexafluoropropylene resin, a vinyl fluoride resin, a vinylidene fluoride resin, dichlorodifluoroethylene resin and copolymers these resins, more preferably a tetrafluoroethylene resin or a vinylidene fluoride resin, and still more preferably a tetrafluoroethylene resin. If the fluorine-based resin particles of the present embodiment contain a tetrafluoroethylene resin, an effect of wear resistance may be achieved.

The average primary particle diameter of the fluorine-based resin particles is preferably from 0.05 μm to 1 μm, and more preferably 0.1 μm to 0.5 μm. When the average primary particle diameter is 0.05 μm or more, progress of aggregation of particles at the time of dispersion may be suppressed, and when the average primary particle diameter is 1 μm or less, occurrence of defects in image quality may be suppressed.

In the present embodiment, the average primary particle diameter of the fluorine-based resin particles refers to a value obtained from a measurement liquid diluted with the same solvent as that used in the dispersion liquid of the fluorine-based resin particles, using a laser diffraction type particle size distribution measuring device LA-700 (trade name, manufactured by Horiba Ltd.), at a refractive index of 1.35.

The charge transport layer 6 contains a charge transport material, which serves to exert the original function as a charge transport layer, and a binder resin, in addition to the above-described components. The charge transport materials include, for example, hole transport materials such as oxadiazole derivatives such as 2,5-bis-diethylaminophenyl)-1,3,4-oxadiazole; pyrazoline derivatives such as 1,3,5-triphenylpyrazoline and 1-[pyridyl-(2)]-3-(p-diethylaminostyryl)-5-(p-diethylaminostyryl)pyrazoline; aromatic tertiary amino compounds such as triphenylamine, N,N'-bis(3,4-dimethylphenyl)biphenyl-4-amine, tri(p-methylphenyl)aminyl-4-amine and dibenzyl aniline; aromatic tertiary diamino compounds such as N,N'-bis(3-methylphenyl)-N,N'-diphenyl benzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenyl hydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenyl aniline; enamine derivatives; carbazole derivatives such as N-ethylcarbazole; and poly-N-vinylcarbazole and the derivative thereof; and electron transport materials such as quinone-based compounds such as chloranil and bromoanthraquinone; tetracyanoquinodimethane compounds; fluorenone compounds such as 2,4,7-trinitrofluorenone and 2,4,5,7-tetranitro-9-flurorenone; xanthone-based compounds; and thiophene compounds, and polymers having a group formed from the above-mentioned compounds in the main chain or a side chain thereof. These charge transport materials can be used singly or in combination of two or more kinds.

Further, the binder resins used in the charge transport layer 6 include, for example, insulative resins such as a polycarbonate resin of bisphenol A-type, bisphenol Z-type or the like, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin and a chlorinated rubber; and an organic photoconductive polymer such as polyvinyl carbazole, polyvinyl anthracene and polyvinyl pyrene. These binder resins may be used singly, or in combination of two or more kinds.

The charge transport layer 6 is formed from a coating liquid in which the above components are added to a predetermined solvent. Solvents used for forming the charge transport layer include, for example, aromatic hydrocarbon solvents such as toluene and chlorobenzene; aliphatic alcohol-based solvents such as methanol, ethanol, n-propanol, iso-propanol, and n-butanol; ketone-based solvents such as acetone, cyclohexanone, and 2-butanone; halogenated aliphatic hydrocarbon solvents such as methylene chloride, chloroform and ethylene chloride; cyclic or straight-chained ether-based solvents such as tetrahydrofuran, dioxane, ethylene glycol, and diethyl ether; and ester-based solvents such as methyl acetate, ethyl acetate and n-butyl acetate. These solvents may be used singly or in combination of two or more kinds. When two or more kinds of solvents are used, any solvents may be used as long as binder resin can be dissolved therein. The compounding ratio of the charge transport material and the binder is preferably from 10:1 to 1:5.

The electrophotographic photoreceptor is generally manufactured by a dip coating method, and it is important to form a flat and smooth surface layer in order to obtain a favorable image. Since an organic solvent is used for the coating liquid, an orange peel phenomenon may occur on the surface layer when dried. In order to prevent such a phenomenon, a leveling agent is often used. As the leveling agent, dimethyl silicone oil is commonly used. However, when dimethyl silicone oil is added to the coating liquid for forming the surface layer, in which the fluorine-based resin particles are dispersed using the copolymer of the present embodiment, aggregation of the fluorine-based resin particles may be caused. As a result, defects due to aggregates of the fluorine-based resin particles may be formed in the surface layer, thereby causing problems in image quality such as black spots or white spots, or causing uneven density due to uneven distribution of the fluorine-based resin particles in the layer.

The inventors have made intensive studies on the above problems, and have found that by using a fluorine-modified silicone oil represented by the following Formula 1 as a leveling agent, aggregation of the fluorine-based resin particles and occurrence of abnomalities in image quality may be suppressed, and the shelf life of the coating liquid may be extended.

Formula 1

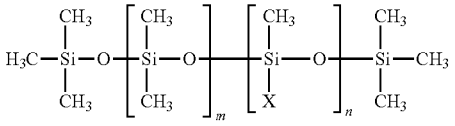

In Formula 1, m and n each independently an integer of 1 or more, and X represents a group containing a fluorine atom.

In the fluorine-modified silicone oil represented by Formula 1, X is preferably a fluoroalkyl group having 1 to 10 carbon atoms, and more preferably a fluoroalkyl group having 1 to 5 carbon atoms.

The fluorine-modified silicone oil represented by Formula 1 may be added in an arbitrary amount to the surface layer as long as the desired characteristics can be achieved, and the amount of the fluorine-modified silicone oil is preferably in the range of from 0.1 ppm, or about 0.1 ppm, to 1,000 ppm, or about 1,000 ppm, and more preferably in the range of from 0.5 ppm to 500 ppm, which respect to the amount of the surface layer, i.e., charge transport layer 6. When the content of the fluorine-modified silicone oil represented by Formula 1 is 0.1 ppm or more, or about 0.1 ppm or more, a surface that is sufficiently flat and smooth may be obtained. When the content of the fluorine-modified silicone oil represented by Formula 1 is 1,000 ppm or less, or about 1,000 ppm or less, unfavorable phenomena in electric characteristics such as increase in residual potential upon repetitive use may be suppressed.

Further, a siloxane compound including repeating units represented by the following Formula D and Formula E may also be used instead of dimethyl silicone oil. By using the above siloxane compound, when a cleaning blade is used to remove residual toner from the surface of the electrophotographic photoreceptor, bending of the edge of the blade at an initial stage of using the blade may be suppressed.

Formula D

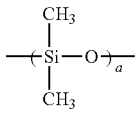

Formula E

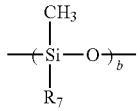

In Formula D and Formula E, $R_7$ represents an alkyl group having 2 or more of carbon atoms, and a and b each independently are an integer of 1 or more. The carbon number of the alkyl group represented by $R_7$ in Formula E is preferably 2 or more, and more preferably 8 or more.

The molecular weight of the siloxane compound of the present embodiment is not particularly limited as long as the siloxane compound can dissolve in a solvent used for forming the charge transport layer 6. Moreover, the content of the siloxane compound of the present embodiment with respect to the total solid content of the surface layer, i.e., the charge transport layer 6, is preferably from 5 ppm, or about 5 ppm, to 1,000 ppm, or about 1,000 ppm, and more preferably from 10 ppm to 500 ppm. When the content of the siloxane compound is 5 ppm or more, or about 5 ppm or more, an effect of preventing the edge of a cleaning blade from bending may be achieved. When the content of the siloxane compound is 1,000 ppm or less, or about 1,000 ppm or less, increase in residual potential may be suppressed.

In the present embodiment, the fluorine-modified silicone oil represented by Formula 1 or a siloxane compound including repeating units represented by Formula D and Formula E may be used singly, or may be used in combination. When the fluorine-modified silicone oil represented by Formula 1 and the siloxane compound including repeating units represented by Formula D and Formula E are used in combination, the total amount thereof is preferably from 1 ppm to 1,000 ppm, and more preferably from 5 ppm to 1,000 ppm. When the fluorine-modified silicone oil represented by Formula 1, and the siloxane compound including repeating units represented by Formula D and Formula E are used in combination, the ratio of the fluorine-modified silicone oil represented by Formula 1 to the siloxane compound including repeating units represented by Formula D and Formula E is preferably in the range of from 99:1 to 1:99.

As a means of dispersing the fluorine-based resin particles in a coating liquid used for forming the charge transport layer 6, media dispersing machines such as a ball mill, a vibration ball mill, an attritor, a sand mill and a lateral sand mill, and medialess dispersing machines such as an agitator, an ultrasonic dispersing machine, a roll mill, and a high-pressure homogenizer, can be used. Furthermore, the high-pressure homogenizer includes a collision-type homogenizer in which a dispersion liquid is dispersed by liquid-liquid collision, or liquid-wall collision under high pressure, or a passing through-type homogenizer in which a dispersion liquid is dispersed by passing the dispersion liquid through thin flow paths under high pressure.

In the present embodiment, the method for preparing the coating liquid for the charge transport layer is not specifically limited, and the coating liquid may be prepared by mixing the fluorine-based resin particles, the copolymer of the present embodiment, the binder resin, the charge transport material and a solvent, and optionally other components, using the above-mentioned dispersing machine, or by separately preparing a liquid A containing the fluorine-based resin particles, the copolymer of the present embodiment and a solvent, and a liquid B containing a binder resin, the charge transport material and a solvent, and then mixing the liquid A and liquid B. By mixing the fluorine-based resin particles and the copolymer of the present embodiment in a solvent, the copolymer of the present embodiment can be sufficiently adhered to the surface of the fluorine-based resin particles.

Alternatively, the coating liquid for the charge transport layer may be prepared by mixing a liquid A', which is obtained by adding the fluorine-based resin particles and the copolymer of the present embodiment to a solvent containing a binder resin, with the above-mentioned liquid B.

When the charge transport layer is formed from a coating liquid for the charge transport layer prepared using the above-mentioned liquid A' obtained by adding the fluorine-based resin particles and the copolymer of the present embodiment to a solvent already containing a binder resin, sensitivity of the obtained electrophotographic photoreceptor may be enhanced.

The amount of the binder resin contained in the mixed liquid A' is preferably from 1% by weight to 70% by weight, and more preferably from 5% by weight to 30% by weight with respect to the amount of the fluorine-based resin particles.

When the fluorine-modified silicone oil represented by Formula 1 and at least one kind of the siloxane compound containing the repeating units represented by Formula D and Formula E are added to the coating liquid for forming the charge transport layer, it is preferable that the fluorine-modified silicone oil and the at least one kind of the siloxane compound are added after the preparation of the coating liquid for forming the charge transport layer in the above-mentioned manner, from the viewpoint of attaining favorable surface properties of the charge transport layer.

The thus obtained coating liquid for forming the charge transport layer can be applied onto the charge generation layer 5 by a known method such as a dip coating method, an extrusion coating method, a wire bar coating method, a spray coating method, a blade coating method, a knife coating method, a curtain coating method or the like. The thickness of the charge transport layer is preferably in the range of from 5 μm to 50 μm, and more preferably in the range of from 10 μm to 40 μm.

For the purpose of preventing deterioration of the photoreceptor due to ozone or nitrogen oxide that is generated in an image forming apparatus, light or heat, additives such as an antioxidant, a light stabilizer or a heat stabilizer may be added in each layer included in the photosensitive layer 3. Examples of the antioxidants include a hindered phenol, a hindered amine, paraphenylene diamine, arylalkane, hyrdoquinone, spirochroman, spiroindanone, derivatives thereof, an organic sulfur compound and an organic phosphorous compound. Examples of the light stabilizers include derivatives of benzophenone, benzoazole, dithiocarbamate and tetramethylpiperine.

In the electrophotographic photoreceptor of the present embodiment, a protective layer may be provided as a surface layer. The protective layer is used to prevent chemical changes of the charge transport layer upon charging of the electrophotographic photoreceptor, or to further improve the mechanical strength of the photosensitive layer. The protective layer may be formed by applying a coating liquid formed by containing an electroconductive material in a suitable binder resin onto the photosensitive layer.

The electroconductive material is not particularly limited, and examples thereof include metallocene compounds such as N,N'-dimethylferrocene; aromatic amine compounds such as N,N'-diphenyl-N,N'-bis(3-methylphenyl)-[1,1'-biphenyl]-4,4'-diamine; molybdenum oxide, tungstic oxide, antimony oxide, tin oxide, titanium oxide, indium oxide; carriers of a solid solution of tin oxide and antimony or a solid solution of barium sulfate and antimony oxide; mixtures of the above metal oxides; materials formed by mixing the above metal oxides in single particles of titanium oxide, tin oxide, zinc oxide, or barium sulfate; and materials formed by coating single particles of titanium oxide, tin oxide, zinc oxide, or barium sulfate with the above metal oxides.

The binder resin used for the protective layer include known resins such as a polyamide resin, a polyvinylacetal resin, a polyurethane resin, a polyester resin, an epoxy resin, a polyketone resin, a polycarbonate resin, a polyvinyl ketone resin, a polystyrene resin, a polyacrylamide resin, a polyimide resin and a polyamideimide resin. These resins may also be used by crosslinking with each other, if needed.

The thickness of the protective layer is preferably from 1 μm to 20 μm, and more preferably 2 μm to 10 μm.

The methods of coating the coating liquid for forming the protective layer include usual methods such as a blade coating method, a wire bar coating method, a spray coating method, a dip coating method, a bead coating method, an air knife coating method, and a curtain coating method. Solvents used for the coating liquid for forming a protective layer include known organic solvents such as dioxane, tetrahydrofuran, methylene chloride, chloroform, chlorobenzene and toluene, and these solvents may be used singly or in combination of two or more kinds. Solvents that are less prone to dissolve the underlying photosensitive layer are preferably used.

The coating liquid for forming the protective layer can be prepared in a manner similar to the method of preparing the coating liquid for the charge transport layer, except that an electroconductive material is used in place of the charge transport material. In the coating liquid for forming the protective layer, the fluorine-modified silicone oil represented by Formula 1 and at least one kind of the siloxane compound containing repeating units represented by Formula D and Formula E may be added in a similar manner to the method of preparing the coating liquid for the charge transport layer. When the photosensitive layer is comprised of a functionally integrated-type single layer, the coating liquid for forming the photosensitive layer may be prepared in a manner similar to the method of preparing the coating liquid for forming the charge transport layer, except that a charge generating material is further added, in addition to the charge transport material. When the fluorine-modified silicone oil represented by Formula 1 and at least one kind of the siloxane compound including the repeating units represented by Formula D and Formula E are added to the coating liquid for forming the photosensitive layer, the coating liquid may be prepared in a similar manner to the method of preparing the coating liquid for forming the charge transport layer.

Image Forming Apparatus and Process Cartridge

Next, the image forming apparatus and the process cartridge of the present embodiment will be explained. Here, the same denotations are given to the members having the same function throughout all the drawings, and the same explanations may be omitted.

Figure 2:
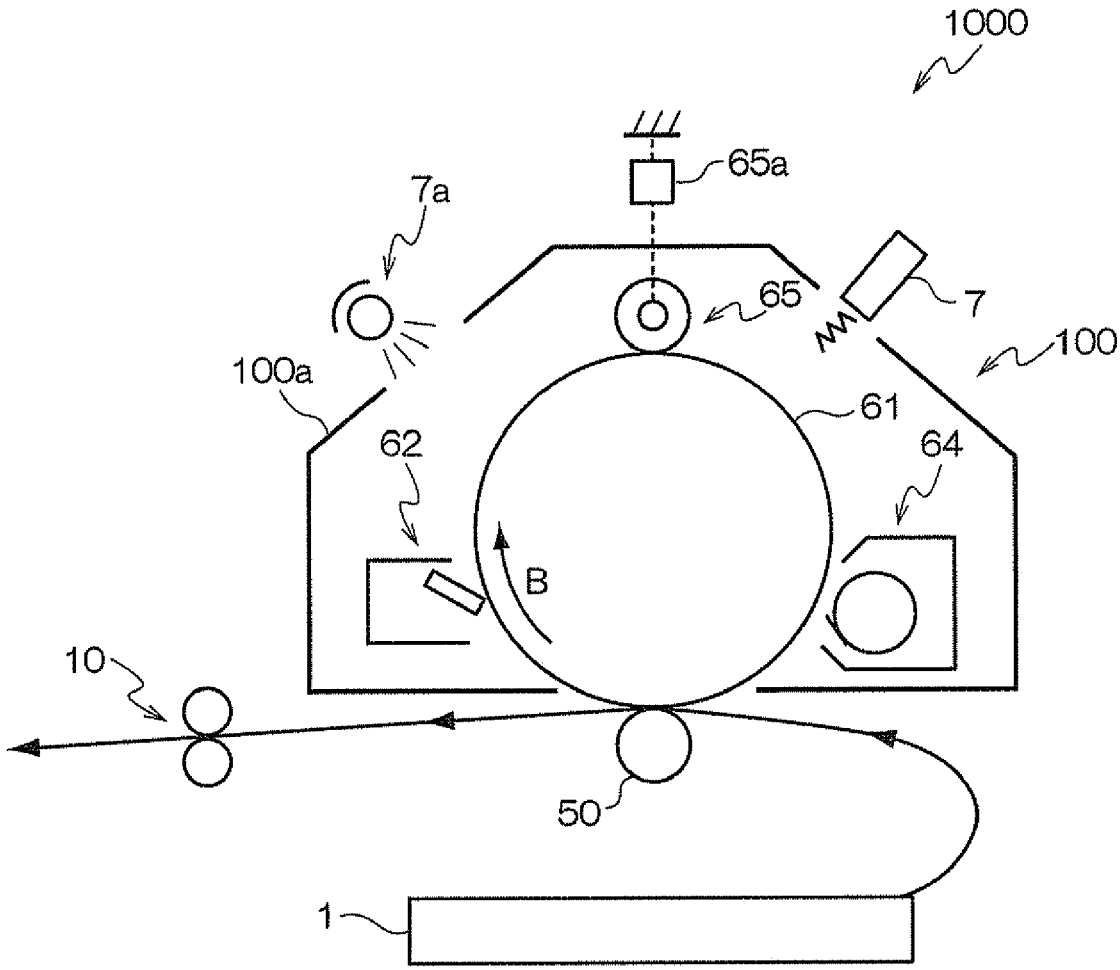
FIG. 2 is an overall view of a first example of an image forming apparatus according to an exemplary embodiment of the present invention.

FIG. 2 is an entire structural drawing showing a first example of an image forming apparatus of the present embodiment. This image forming apparatus 1000 is a monochromatic single-side output printer employing an electrophotographic system.

The image forming apparatus 1000 is equipped with an image holding member 61 which is an electrophotographic photoreceptor that rotates in a direction indicated by an arrow B, and a charging member 65 which is a charging means that charges the surface of the image holding member 61 while rotating in contact with the image holding member 61, driven by a power source 65*a*. Here, the image holding member 61 corresponds to an example of the electrophotographic photoreceptor of the present embodiment.

The image forming apparatus 1000 comprises an exposure unit 7 as an electrostatic latent image forming means that emits a laser beam towards the image holding member 61 to form a latent image having a higher electric potential than that of the peripheral area thereof on the surface of the image holding member 61; a developing unit 64 as a means of forming an image that forms a toner image by developing the electrostatic latent image formed on the surface of the image holding member 61 by adhering monochromatic (black) toner to the electrostatic latent image using a developer containing the black toner; a transfer roll 50 as a means of transferring the toner image formed on the surface of the image holding member 61 onto a sheet of paper as an image receiving member by pressing the sheet of paper against the image holding member 61 having the toner image thereon; a fixing unit 10 as a means of fixing the transferred image by applying heat and pressure to the toner image transferred onto the sheet of paper; a cleaning unit 62 as a means of cleaning residual toner that is remaining and adhering onto the surface of the image holding member 61 by contacting the image holding member 61; and a discharge lamp 7*a* that eliminates residual charges remaining on the image holding member 61 after transferring the toner image.

In the image forming apparatus 1000, the above charging member 65 and the image holding member 61 are in the shape of a roll extending in a direction perpendicular to the plane of FIG. 2, and the both ends of these rolls are supported by a support member 100*a* such that the rolls can rotate. Further, the cleaning unit 62 and the development unit 64 are also attached to the support member 100*a*. The process cartridge 100 is formed by integrating the charging member 65, the image holding member 61, the cleaning unit 62 and the developing unit 64, by the support member 100*a*.

By incorporating the process cartridges in the image forming apparatus 1000, each component of the process cartridge is provided to the image forming apparatus 1000. The process cartridge 100 corresponds to an example of the process cartridge of the present embodiment.

Hereafter, operations of forming an image in the image forming apparatus 1000 will be explained.

The image forming apparatus 1000 is equipped with a toner cartridge containing a black toner (not shown), from which the toner is supplied to the developing unit 64. Sheets of recording medium for transferring the toner thereon are stacked in a storage member 1, from which the recording medium is conveyed from the paper storage member 1 to a transfer roll 50 upon instructions for forming an image by a user. After transferring a toner image onto the recording medium at the transfer roll 50, the recording medium is conveyed to the left side of the drawing. In FIG. 2, the route of conveying the recording medium is shown by arrows pointing to the left. The recording medium is conveyed to the fixing unit 10, at which the image that has been transferred onto the recording medium is fixed. Thereafter, the recording medium is conveyed out to the left side.

When the image holding member 61 is charged by the charging member 65, a voltage is applied to the charging member 65. When a direct current voltage is applied, the amount thereof is preferably in the range of from 50 V to 2,000 V, and more preferably in the range of from 100 V to 1,500 V, either positive or negative voltage in accordance with the charging potential required for the image holding member. When an alternating current voltage is overlaid, the interpeak voltage is in the range of from 400 V to 1,800 V, preferably in the range of from 800 V to 1,600 V, and more preferably in the range of from 1,200 V to 1,600 V. The frequency of the alternating current voltage is in the range of from 50 Hz to 20,000 Hz, and preferably in the range of from 100 Hz to 5,000 Hz.

As the charging member 65, a member comprised of a core material onto which an elastic layer, a resistance layer, a protective layer, and the like are formed is suitably used. The charging member 65, positioned in contact with the image holding member 61, is rotated at the same peripheral velocity as the image holding member 61 without a drive means and functions as a charging means. However, the charging member 65 may be driven by a drive means to be rotated at a different peripheral velocity from that of the image holding member 61, and perform charging.

As an exposure unit 7, an optical system apparatus which can expose the surface of the electrophotographic photoreceptor image wisely to light by a light source such as a semiconductor laser, an LED (light emitting diode), and a liquid crystal shutter, can be used.

As the developing unit 64, known development units using a normal or reversal developer of one-component or two-component system may be used. The shape of the toner particles used in the developing unit 64 is not specifically limited, and particles having an amorphous shape, spherical shape, or the like, may be used.

As the transfer means, in addition to a contact charging member such as transfer roll 50, a contact type transfer charging unit using a belt, film, rubber blade or the like, or a scorotoron transfer charging unit and a corotoron transfer charging unit employing corona discharge, may be used.

The cleaning unit 62 is used for removing residual toner adhered to the surface of the electrophotographic photoreceptor after the transfer process, and the electrophotographic photoreceptor whose surface has been cleaned is subjected to the above-mentioned image forming process again. The cleaning may be carried out using a cleaning blade, a cleaning brush, a cleaning roll or the like, but the cleaning blade is preferably used. The material for the cleaning blade may be polyurethane rubber, neoprene rubber, silicone rubber or the like. Since the surface layer of the electrophotographic photoreceptor of the present embodiment contains fluorine-based resin particles, the surface energy thereof is low. Therefore, wearing of the surface due to the use of a cleaning blade as the cleaning unit 62 does not readily occur, and images can be formed in a stable manner, over a long period of time.

Since the image forming apparatus of the present embodiment is provided with the discharge lamp 7*a*, a phenomenon that a residual potential on the electrophotographic photoreceptor remains in the next cycle can be prevented, thereby further improving image quality. In the image forming apparatus of the present embodiment, the discharge lamp 7*a* may be optionally provided, as occasion demands.

Figure 3:
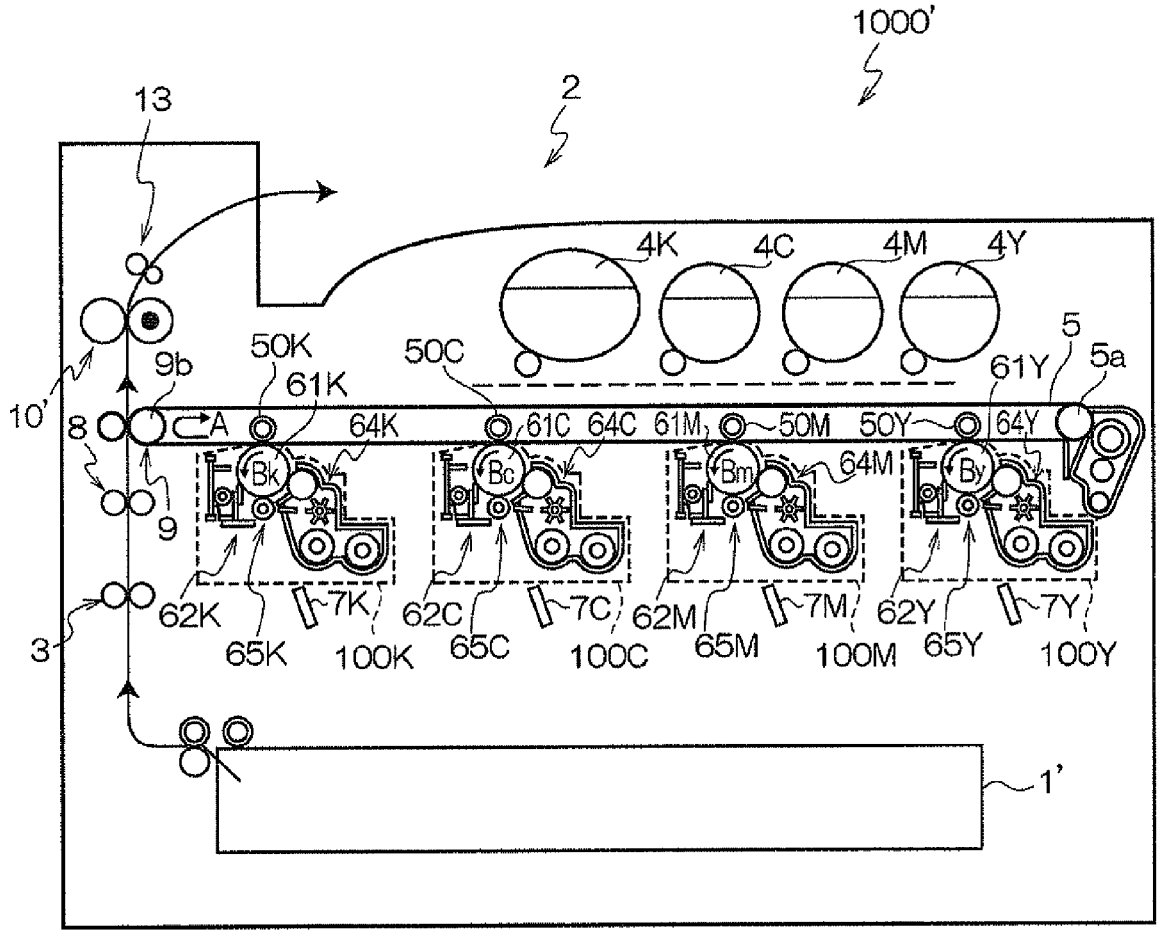
FIG. 3 is an overall view of a second example of an image forming apparatus according to an exemplary embodiment.

FIG. 3 is an overall view of a second example of the image forming apparatus of the present embodiment.

The image forming apparatus 1000' of this embodiment is a single-side output color printer.

The image forming apparatus 1000' is equipped with image holding members 61K, 61C, 61M and 61Y, which are electrophotographic photoreceptors that are rotated in directions indicated by arrows Bk, Bc, Bm and By, respectively. The image holding members 61K, 61C, 61M and 61Y correspond to examples of the electrophotographic photoreceptor of the present embodiment.

On the periphery of each image holding member, charging members 65K, 65C, 65M and 65Y as charging means that charge the surfaces of the image holding members, respectively, by rotating while contacting the image holding members; exposure units 7K, 7C, 7M and 7Y as electrostatic latent image-forming means that form electrostatic latent images for each color of black (K), cyan (C) magenta (M) and yellow (Y) by irradiating the charged image holding members With laser light; and development units 64K, 64C, 64M and 64Y as image forming means that develop the electrostatic latent image formed on respective image holding members with developers containing the toners of respective colors, thereby forming a toner image of respective colors.

In the image forming apparatus 1000', the charging member 65K, the image holding member 61K, the cleaning unit 62K, and the developing unit 64K for a black color are integrated to form a process cartridge 100K. Similarly, the charging member 65C, the image holding member 61C, the cleaning unit 62C, and the developing unit 64C for a cyan color are integrated to form a process cartridge 100C, the charging member 65M, the image holding member 61M, the cleaning unit 62M, and the developing unit 64M for a magenta color are integrated to form a process cartridge 100M, and the charging member 65Y, the image holding member 61Y, the cleaning unit 62Y, and the developing unit 64Y for a yellow color are integrated to form a process cartridge 100Y, respectively. By incorporating these process cartridges 100K, 100C, 100M and 100Y in the image forming apparatus 1000', components of the process cartridges are provided to the image forming apparatus 1000'. Each of the process cartridges 100K, 100C, 100M and 100Y corresponds to an example of the process cartridge of the embodiment.

The image forming apparatus 1000' includes an intermediate transfer belt 5 serving as an intermediate transfer body that conveys a primary transferred image upon receipt of transfer (primary transfer) of a toner image of each color formed on each image holding member; primary transfer rolls 50K, 50C, 50M and 50Y that performs primary transfer of the toner image of each color to the intermediate transfer belt 5; a secondary transfer roll pair 9 that performs secondary transfer to an recording medium; a fixing unit 10' as a fixing means that fixes the toner image formed by the secondary transfer on the recording medium; four toner cartridges 4K, 4C, 4M and 4Y that supply toner of each color component to the four development units, respectively; and a storage member 1' that stores recording media.

The image receiving body in the present embodiment is not specifically limited, as long as a toner image formed on the electrophotographic photoreceptor can be transferred thereon. For example, when an image is directly transferred onto a recording medium from the electrophotographic photoreceptor, the recording medium refers to an image receiving body, and when an intermediate transfer body is used, the intermediate transfer body refers to an image receiving body.

The intermediate transfer belt 5 is stretched on a secondary transfer roll 9*b* and a drive roll 5*a*, and is driven by a drive force from the drive roll 5*a* to move in a direction indicated by an arrow A in a circular manner.

In the above description, the intermediate transfer belt 5 is used as an intermediate transfer body, but the intermediate transfer body may be either belt-shaped or drum-shaped. When the intermediate transfer body is in the form of a belt, materials thereof may be known resins such as a polyimide resin, a polycarbonate resin (PC), a polyvinylidene fluoride (PVDF), a polyalkylene terephthalate (PAT), blend materials such as an ethylene tetrafluoroethylene copolymer (ETFE)/PC, an ETFE/PAT and a PC/PAT, polyester, polyether ether-ketone and polyamide, and resin materials formed from these materials as a main raw material. Furthermore, a blend of a resin material and an elastic material may be used.

Next, operation for forming an image in this image forming apparatus 1000' will be explained.

The four image holding members 61K, 61C, 61M, and 61Y are charged by the charging members 65K, 65C, 65M, and 65Y respectively, and an electrostatic latent image is formed on each image holding member by the laser light emitted from the exposure units 7K, 7C, 7M, and 7Y. The formed electrostatic latent image is developed with a developer containing a toner of each color by the developing units 64K, 64C, 64M, and 64Y, thereby forming a toner image. The thus formed toner images of respective colors are then sequentially transferred onto the intermediate transfer belt 5 in the order of yellow (Y), magenta (M), cyan (C) and black (K) in order to overlap each other, by means of the primary transfer rolls 50K, 50C, 50M and 50Y corresponding to each color, thereby forming a primary multicolor transferred image (primary transfer step).

Subsequently, the multicolor primary transferred image is conveyed to the secondary transfer roll pair 9 by the intermediate transfer belt 5. On the other hand, in synchronism with the formation of the primary multicolor transferred image, a recording medium is taken out from the storage member 1', conveyed out by the conveyance roll 3, and the position thereof is adjusted by a registration roll pair 8. The primary multicolor transferred image is then transferred onto the recording medium that has been conveyed in by the secondary transfer roll pair 9 (secondary transfer). Thereafter, the secondary transferred image on the recording medium is subjected to a fixing process by a fixing unit 10'. After the fixing process, the recording medium with the fixed image is passed through a discharge roll pair 13 and discharged into a paper discharge table 2.

The above is explanation about operation of forming an image carried out in the image forming apparatus 1000'.

The process cartridge of the present embodiment includes, in an integral manner, the electrophotographic photoreceptor according to the present embodiment and at least one selected from the group consisting of a charging unit that charges the surface of the electrophotographic photoreceptor, an electrostatic latent image forming unit that forms an electrostatic latent image on the surface of the charged electrophotographic photoreceptor, an image forming unit that forms a toner image by developing the electrostatic latent image formed on the surface of the electrophotographic photoreceptor with a developer, a transfer unit that transfers the toner image formed on the surface of the electrophotographic photoreceptor onto the surface of an image receiving member, and a cleaning unit that removes residual toner remaining on the surface of the electrophotographic photoreceptor after the transfer. The process cartridge is detachably mounted to an image forming apparatus main body.

EXAMPLES

Hereinafter, the present invention will be explained in more details with reference to the Examples and Comparative Examples, but the present invention will no be limited thereto.

Example 1

100 parts by weight of zinc oxide (mean particle diameter: 70 nm, manufactured by Tayca Corporation, value of specific surface area: 15 $m^2/g$) is mixed with 500 parts by weight of methanol, and 1.25 parts by weight of a silane coupling agent, KBM603 (trade name, manufactured by Shin-Etsu Chemical Co., Ltd.) is added to the mixture, and the resultant mixture is agitated for 2 hours. Thereafter, methanol is distilled away from the mixture under reduced pressure and baking is performed at 120° C. for 3 hours, thereby obtaining zinc oxide particles which are surface-treated with a silane coupling agent.

38 parts by weight of a solution, which is prepared by dissolving 60 parts by weight of the above surface-treated zinc oxide particles, 0.6 parts by weight of alizarin, 13.5 parts by weight of a blocked isocyanate (SUMIJOULE 3173 (trade name), manufactures by Sumitomo Bayer Urethane Co., Ltd.) as a curing agent and 15 parts by weight of butyral resin (S-LEC BM-1 (trade name), manufactured by Sekisui Chemical Co., Ltd.) in 85 parts by weight of methylethyl ketone, is mixed with 25 parts by weight of methylethyl ketone, and the mixture is dispersed by a sand mill with glass beads having a diameter of 1 mm for 4 hours to obtain a dispersion. To the obtained dispersion liquid are added 0.005 parts by weight of dioctyltinlaurate as a catalyst and 4.0 parts by weight of silicone resin particles (TOSPEARL 145 (trade name), manufactured by GE Toshiba Silicones Co., Ltd.) to obtain a coating liquid for an undercoat layer. The obtained coating liquid is applied onto an aluminum substrate having a diameter of 30 mm by a dip coating method, and the formed coating is dried and cured at 180° C. for 40 minutes, thereby obtaining an undercoat layer with a thickness of 25 μm.

Next, a mixture of 15 parts by weight of a chlorogallium phthalocyanine crystal having strong diffraction peaks at least at 7.4°, 16.6°, 25.5° and 28.3° of Bragg angles (2θ±0.2°) with respect to CuKα characteristic X ray, 10 parts by weight of vinyl chloride-vinyl acetate copolymer resin (VMCH (trade name), manufactured by Union Carbide Japan KK) and 300 parts by weight of n-butyl alcohol is dispersed by a sand mill with glass beads having a diameter of 1 mm for 4 hours to obtain a coating liquid for forming a charge generation layer. The coating liquid for forming a charge generation layer is applied onto the undercoat layer by a dip coating method and dried, thereby obtaining a charge generation layer with a thickness of 0.2 μm.

Next, a liquid A (a suspension of tetrafluoroethylene resin particles) is prepared by mixing 0.5 parts by weight of tetrafluoroethylene resin particles (average primary diameter: 0.2 μm) and 0.01 part by weight of a fluorinated alkyl group-containing copolymer having repeating units represented by the following Formula (I) (weight average molecular weight: 50,000, 1:m=1:1, s=1 and n=60) with 4 parts by weight of tetrahydrofuran and 1 part by weight of toluene, and agitating the mixture for 48 hours while maintaining the liquid temperature at 20° C.

Further, a liquid B is prepared by mixing 2 parts by weight of N,N'-bis(3-methylphenyl)-N,N'-diphenyl benzidine, 2 parts by weight of N,N'-bis(3,4-dimethylphenyl)biphenyl-4-amine, 6 parts by weight of bisphenol Z-type polycarbonate resin (viscosity average molecular weight: 40,000), as charge transport materials, and 0.1 part by weight of 2,6-di-t-butyl-4-methyl phenol, as an antioxidant, and dissolving the mixture in 24 parts by weight of tetrahydrofuran and 11 parts by weight of toluene.

After adding the liquid A to the liquid B and mixing by agitating, the mixture is subjected to a dispersion treatment by increasing the pressure to 500 $kgf/cm^2$ using a high-pressure homogenizer having a passing-through chamber with thin flow paths (manufactured by Yoshida Kikai Co., Ltd.), and the process is repeated for six times. To this liquid is added a fluorine-modified silicone oil (FL-100 (trade name), manufactured by Shin-Etsu Silicones) in an amount of 5 ppm, and the mixture is sufficiently agitated. A coating liquid for forming a charge transport layer is thus obtained.

Formula (I)

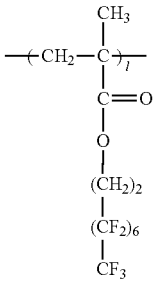

-continued

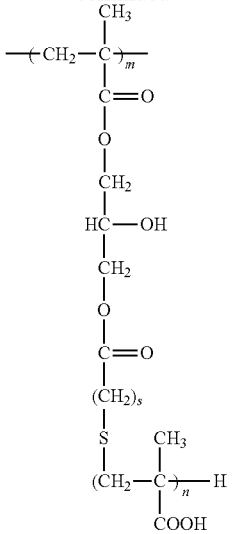

This coating liquid is applied onto the charge generation layer and dried at 115° C. for 40 minutes to form a charge transport layer with a thickness of 32 μm, thereby obtaining an electrophotographic photoreceptor.

The thus obtained electrophotographic photoreceptor is subjected to the following tests. The results are shown in Table 1.

The electrophotographic photoreceptor is mounted onto a drum cartridge of a full color printer, DocuCentre Color f450 (trade name, manufactured by Fuji Xerox Co., Ltd.), and an initial print test is performed by printing a pattern of blank, half-tone and 1-dot lines, respectively. In the print test (blank), existence or absence of black spots is visually inspected. In the print test (half-tone), existence or absence of density unevenness in a dot pattern is visually inspected. In the print test (1-dot line reproducibility), line reproducibility in a radial pattern formed by one-dot lines is visually inspected.

In order to test the repetitive printability, a 50,000-sheet print test is conducted based on an image with an area coverage of 5% including a 1-dot line color image of A4 size, under high temperature and high humidity of 28° C. and 85% RH. Values of residual potentials (VRp) after electrodischarging the electrophotographic photoreceptor are measured at the commencement and at the end of the 50,000-sheet print test, and the difference between these values are determined as the difference in residual potential (ΔRp). Further, a cross-section of the electrophotographic photoreceptor after completing the 50,000-sheet print test is observed with an electron microscope, and the thickness of the charge transport layer is measured to determine the amount of wear of the electrophotographic photoreceptor. The amount of wear is normalized with the number of cycles of the electrophotographic photoreceptor (one revolution of the photoreceptor corresponds to one cycle), and the wear rate is calculated therefrom.

Further, bending of the edge of a cleaning blade at the initial stage is evaluated by contacting the cleaning blade with the photoreceptor and visually observing the state of contacting of the cleaning blade after 30 revolutions of the photoreceptor A light-induced fatigue test of the electrophotographic photoreceptor is conducted by irradiating the electrophotographic photoreceptor with light of 1,000 lux for 10 minutes in a continuous manner, and evaluating the difference (ΔVL) in surface potentials at an irradiated area and a non-irradiated area using an electric potential measurement scanner.

Example 2

An electrophotographic photoreceptor is obtained using a coating liquid for forming a charge transport layer that is prepared in a similar manner to Example 1, except that dimethyl silicone oil (KP-340 (trade name) manufactured by Shin-Etsu Silicones) is used in place of the fluorine-modified silicone oil. The obtained electrophotographic photoreceptor is evaluated in a similar manner to Example 1. The results are shown in Table 1.

Example 3

An undercoat layer and a charge generation layer are obtained in a similar manner to Example 1.

Next, a suspension of tetrafluoroethylene resin particles is obtained by mixing 0.5 parts by weight of tetrafluoroethylene resin particles (average primary diameter: 0.2 μm), 0.01 part by weight of a fluorinated alkyl group-containing copolymer represented by the following Formula (II) (random copolymer, weight average molecular weight: 15,000, ratio of 1:m is 1:1, n is about 60) with 4 parts by weight of tetrahydrofuran and 1 part by weight of toluene, and stirring for 48 hours while maintaining a liquid temperature at 20° C.

Further, 2 parts by weight of N,N'-bis(3-methylphenyl)-N,N'-diphenyl benzidine, 2 parts by weight of N,N'-bis(3,4-dimethylphenyl)biphenyl-4-amine and 6 parts by weight of bisphenol Z-type polycarbonate resin (viscosity average molecular weight: 40,000), as charge transport materials, and 0.1 part by weight of 2,6-di-t-butyl-4-methyl phenol, as an antioxidant, are mixed and dissolved in 24 parts by weight of tetrahydrofuran and 11 parts by weight of toluene.

Formula (II)

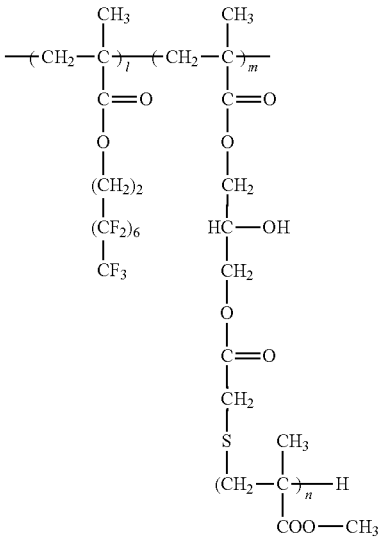

After adding the above-prepared tetrafluoroethylene resin particle suspension to the above mixture and mixing by agitating, the mixture is subjected to a dispersion treatment by increasing the pressure to 500 kgf/cm$^2$ using a high-pressure homogenizer having a passing-through chamber with thin flow paths (manufactured by Yoshida Kikai Co., Ltd.), and the dispersion process is repeated for six times. A long chain alkyl-modified polysiloxane including repeating units represented by the following Formula (III) (weight average molecular weight is 70,000 and a:b=1:1) is further added to the dispersion in an amount of 200 ppm, thereby obtaining a coating liquid for forming a charge transport layer.

The coating liquid is applied onto the charge generation layer and dried at 115° C. for 40 minutes to form a charge transport layer with a thickness of 29 μm, thereby obtaining an electrophotographic photoreceptor. The electrophotographic photoreceptor is evaluated in a similar manner to Example 1. The obtained results are shown in Table 1.

Formula (III)

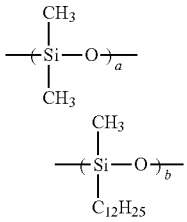

Example 4

An electrophotographic photoreceptor is prepared in a similar manner to Example 3, except that the fluorinated alkyl group-containing copolymer is changed to 0.01 part by weight of a fluorinated alkyl group-containing copolymer having a structure represented by the following Formula (IV) (random copolymer, weight average molecular weight is 15,000, ratio of 1:m is 1:1, and n is about 60). The obtained electrophotographic photoreceptor is evaluated in a similar manner to Example 1. The obtained results are shown in Table 1.

Formula (IV)

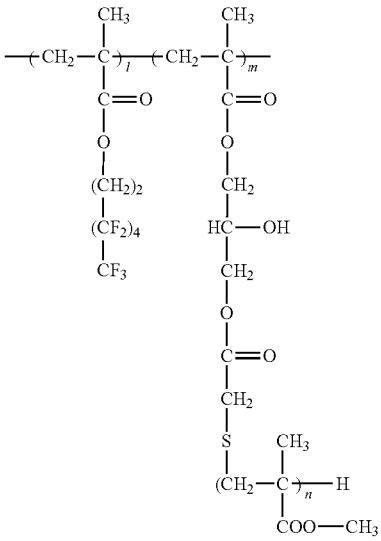

Example 5

An electrophotographic photoreceptor is prepared in a similar manner to Example 3, except that the fluorinated alkyl group-containing copolymer is changed to 0.01 part by weight of a fluorinated alkyl group-containing copolymer having a structure represented by the following Formula (V) (random copolymer, weight average molecular weight is 15,000, ratio of 1:m is 1:1, and n is about 60). The obtained electrophotographic photoreceptor is evaluated in a similar manner to Example 1. The obtained results are shown in Table 1.

Formula (V)

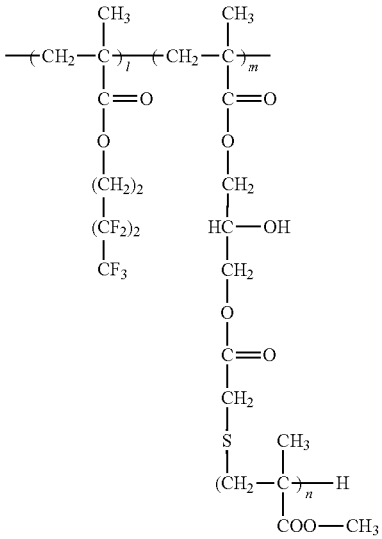

Example 6

An electrophotographic photoreceptor is prepared in a similar manner to Example 3, except that a coating liquid for forming a charge transport layer in which the long chain alkyl-modified polysiloxane is changed to a long chain alkyl-modified polysiloxane including repeating units represented by the following Formula (VI) (weight average molecular weight is 10,000 and a:b=2:1) in an amount of 200 ppm is used. The obtained electrophotographic photoreceptor is evaluated in a similar manner to Example 1. The obtained results are shown in Table 1.

Formula (VI)

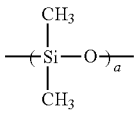

-continued

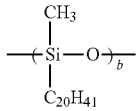

Comparative Example 1

An electrophotographic photoreceptor is prepared in a similar manner to Example 3, except that the fluorinated alkyl group-containing copolymer is changed to 0.01 part by weight of a fluorinated alkyl group-containing copolymer having a structure represented by the following Formula (VII) (random copolymer, weight average molecular weight is 15,000, ratio of 1:m is 1:1, and n is about 60). The obtained electrophotographic photoreceptor is evaluated in a similar manner to Example 1. The obtained results are shown in Table 1.

Formula (VII)

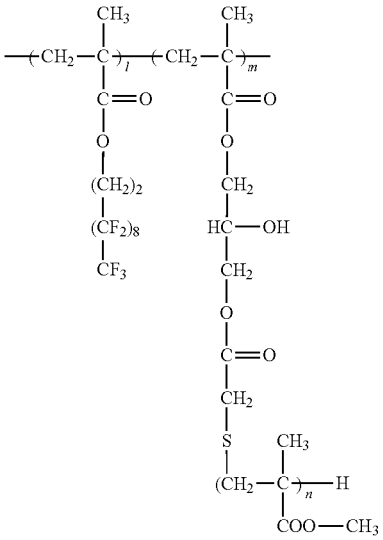

Comparative Example 2

An electrophotographic photoreceptor is prepared in a similar manner to Example 3, except that the fluorinated alkyl group-containing copolymer is changed to 0.01 part by weight of a fluorinated alkyl group-containing copolymer having a structure represented by the following Formula (VIII) (random copolymer, weight average molecular weight is 15,000, ratio of 1:m is 1:1, and n is about 60). The obtained electrophotographic photoreceptor is evaluated in a similar manner to Example 1. The obtained results are shown in Table 1.

Formula (VIII)

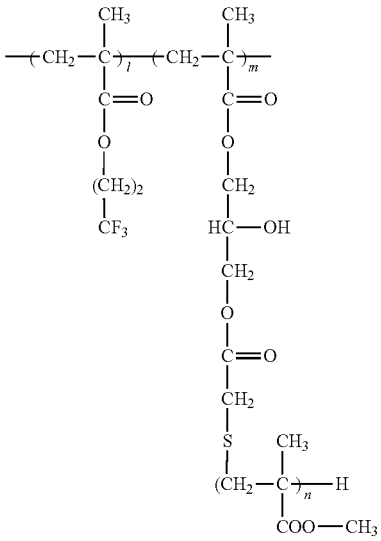

Example 7

An electrophotographic photoreceptor is prepared in a similar manner to Example 3, except that a coating liquid for forming a charge transport layer in which the long chain alkyl-modified polysiloxane is changed to a polysiloxane represented by the following Formula (IX) (weight average molecular weight: 80,000) in an amount of 200 ppm is used. The obtained electrophotographic photoreceptor is evaluated in a similar manner to Example 1 The obtained results are shown in Table 1.

Formula (IX)

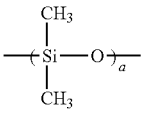

Example 8

An electrophotographic photoreceptor is prepared in a similar manner to Example 3, except that a coating liquid for forming a charge transport layer in which the long chain alkyl-modified polysiloxane is changed to a polysiloxane including repeating units represented by the following Formula (X) (weight average molecular weight is 15,000 and a:b=1:1) in an amount of 200 ppm is used. The obtained electrophotographic photoreceptor is evaluated in a similar manner to Example 1. The obtained results are shown in Table 1.

Formula (X)

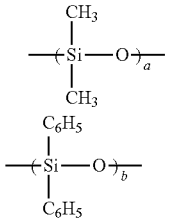

Example 9

An electrophotographic photoreceptor is prepared in a similar manner to Example 3, except that the polysiloxane is not added. The obtained electrophotographic photoreceptor is evaluated in a similar manner to Example 1. The obtained results are shown in Table 1.

Comparative Example 3

An undercoat layer and a charge generation layer are obtained in a similar manner to Example 1.

Next, a suspention of tetrafluoroethylene resin particles is obtained by mixing 0.5 parts by weight of tetrafluoroethylene resin particles (average primary diameter is 0.2 μm) and 0.01 part by weight of a fluorinated alkyl group-containing copolymer having a structure represented by the following Formula (XI) (random copolymer, weight average molecular weight is 30,000, ratio of 1:n is 1:1, r is about 60) with 4 parts by weight of tetrahydrofuran and 1 part by weight of toluene, and stirring for 48 hours while maintaining a liquid temperature at 20° C.

Further, 2 parts by weight of N,N'-bis(3-methylphenyl)-N,N'-diphenyl benzidine, 2 parts by weight of N,N'-bis(3,4-dimethylphenyl)biphenyl-4-amine, and 6 parts by weight of bisphenol Z-type polycarbonate resin (viscosity average molecular weight is 40,000), as charge transport materials, and 0.1 part by weight of 2,6-di-t-butyl-4-methyl phenol, as an antioxidant, are mixed and dissolved in 24 parts by weight of tetrahydrofuran and 11 parts by weight of toluene.

After adding the above-prepared tetrafluoroethylene resin particle suspension to the above mixture and mixing by agitating, the mixture is subjected to a dispersion treatment by raising a pressure up to 500 kgf/cm$^2$ using a high-pressure homogenizer having a passing-through chamber with thin flow paths (manufactured by Yoshida Kikai Co., Ltd.), and the dispersion treatment is repeated for six times, thereby obtaining a coating liquid for a charge transport layer.

The coating liquid is applied onto the charge generation layer and dried at 115° C. for 40 minutes to form a charge transport layer with a thickness of 30 μm, thereby obtaining an electrophotographic photoreceptor. The obtained electrophotographic photoreceptor is evaluated in a similar manner to Example 1. The obtained results are shown in Table 1.

Formula (XI)

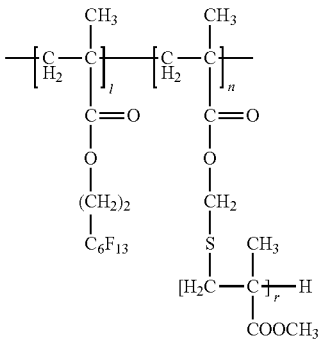

Comparative Example 4

An electrophotographic photoreceptor is prepared in a similar manner to Comparative Example 3, except that the fluorinated alkyl group-containing copolymer is changed to 0.01 part by weight of a fluorinated alkyl group-containing copolymer having a structure represented by the following Formula (XII) (random copolymer, weight average molecular weight is 30,000, ratio of 1:n is 1:1, and r is about 60). The obtained electrophotographic photoreceptor is evaluated in a similar manner to Example 1. The obtained results are shown in Table 1.

Formula (XII)

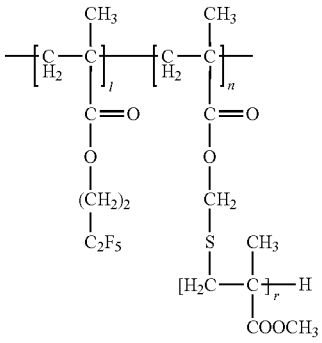

Comparative Example 5

An electrophotographic photoreceptor is prepared in a similar manner to Comparative Example 3, except that the fluorinated alkyl group-containing copolymer is changed to 0.01 part by weight of a fluorinated alkyl group-containing copolymer having the following Formula (XIII) (random copolymer, weight average molecular weight is 40,000, ratio of 1:n is 4:6, and r is about 60). The obtained electrophotographic photoreceptor is evaluated in a similar manner to Example 1. The obtained results are shown in Table 1.

Formula (XIII)

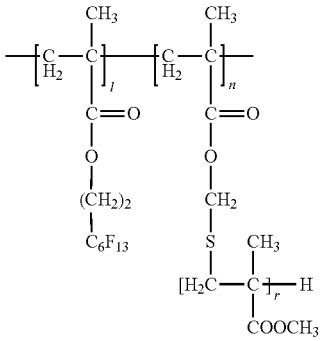

Comparative Example 6

An electrophotographic photoreceptor is prepared in a similar manner to Comparative Example 3, except that the fluorinated alkyl group-containing copolymer is changed to 0.01 part by weight of a fluorinated alkyl group-containing copolymer having the following Formula (XIV) (random copolymer, weight average molecular weight is 30,000, ratio of 1:n is 6:4, and r is about 60). The obtained electrophotographic photoreceptor is evaluated in a similar manner to Example 1. The obtained results are shown in Table 1.

Formula (XIV)

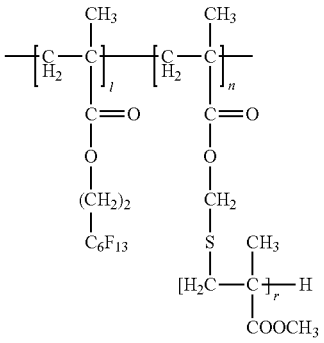

Comparative Example 7

An electrophotographic photoreceptor is prepared in a similar manner to Comparative Example 3, except that the fluorinated alkyl group-containing copolymer is changed to 0.01 part by weight of a fluorinated alkyl group-containing copolymer having a structure represented by the following Formula (XV) (random copolymer, weight average molecular weight is 35,000, ratio of 1:m:n is 4:1:5, and r is about 60). The obtained electrophotographic photoreceptor is evaluated in a similar manner to Example 1. The obtained results are shown in Table 1.

Formula (XV)

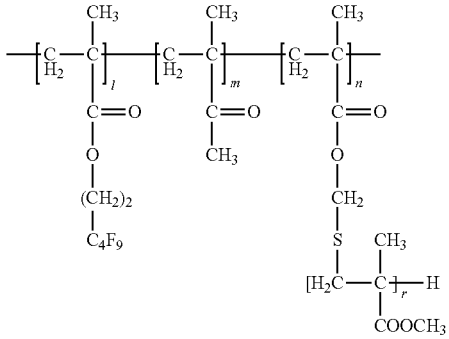

Comparative Example 8

An electrophotographic photoreceptor is prepared in a similar manner to Comparative Example 3, except that the fluorinated alkyl group-containing copolymer is changed to 0.01 part by weight of a fluorinated alkyl group-containing copolymer having the following Formula (XVI) (random copolymer, weight average molecular weight is 30,000, ratio of 1:m:n is 5:1:4, and r is about 60). The obtained electrophotographic photoreceptor is evaluated in a similar manner to Example 1. The obtained results are shown in Table 1.

Formula (XVI)

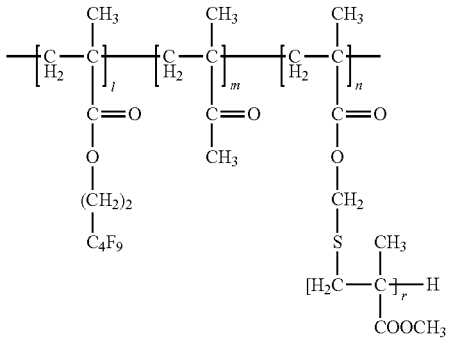

Comparative Example 9

An electrophotographic photoreceptor is prepared in a similar manner to Comparative Example 3, except that the fluorinated alkyl group-containing copolymer is changed to 0.01 part by weight of a fluorinated alkyl group-containing copolymer having the following Formula (XVII) (random copolymer, weight average molecular weight is 30,000, ratio of 1:n is 1:1, and r is about 60). The obtained electrophotographic photoreceptor is evaluated in a similar manner to Example 1. The obtained results are shown in Table 1.

Formula (XVII)

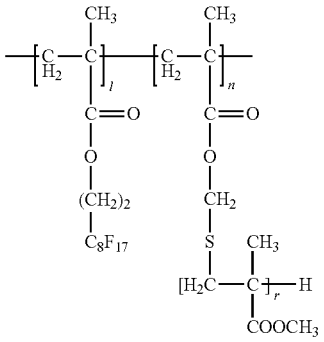

Comparative Example 10

An electrophotographic photoreceptor is prepared in a similar manner to Comparative Example 3 except that the fluorinated alkyl group-containing copolymer is changed to 0.01 part by weight of a fluorinated alkyl group-containing copolymer having the following Formula (XVIII) (random copolymer, weight average molecular weight is 20,000, ratio of 1:n is 1:1, and r is about 60). The obtained electrophotographic photoreceptor is evaluated in a similar manner to Example 1. The obtained results are shown in Table 1.

Formula (XVIII)

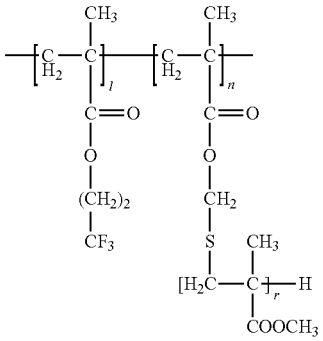

Example 10

An undercoat layer and a charge generation layer are obtained in a similar manner to Example 1.

Next, a suspention of tetrafluoroethylene resin particles (liquid A) is obtained by mixing 0.5 parts by weight of tetrafluoroethylene resin particles (average primary diameter is 0.2 μm), 0.01 part by weight of a fluorinated alkyl group-containing copolymer having a structure represented by the following Formula (XIX) (random copolymer, weight average molecular weight is 30,000, ratio of 1:m is 1:1, n is about 60, and s is 1) and 0.15 parts by weight (30% by weight with respect to the tetrafluoroethylene resin particles) of bisphenol Z-type polycarbonate resin (viscosity average molecular weight is 40,000) with 4 parts by weight of tetrahydrofuran and 1 part by weight of toluene, and stirring for 48 hours while maintaining a liquid temperature at 20° C.

Further, 2 parts by weight of N,N'-bis(3 -methylphenyl)-N,N'-diphenyl benzidine, 2 parts by weight of N,N'-bis(3,4-dimethylphenyl)biphenyl-4-amine, and 6 parts by weight of bisphenol Z-type polycarbonate resin (viscosity average molecular weight is 40,000), as charge transport materials, and 0.1 part by weight of 2,6-di-t-butyl-4-methyl phenol, as an antioxidant, are mixed and dissolved in 24 parts by weight of tetrahydrofuran and 11 parts by weight of toluene (liquid B).

After adding liquid A to liquid B and mixing by agitating, the mixture is subjected to a dispersion treatment by increasing the pressure to 500 kgf/cm$^2$ using a high-pressure homogenizer having a passing through chamber with thin flow paths (manufactured by Yoshida Kikai Co., Ltd.), and the dispersion treatment is repeated for six times. A coating liquid for forming a charge transport layer is thus obtained.

The coating liquid is applied onto the charge generation layer and dried at 115° C. for 40 minutes to form a charge transport layer with a thickness of 29 μm, thereby obtaining an electrophotographic photoreceptor. The obtained electrophotographic photoreceptor is evaluated in a similar manner to Example 1. The obtained results are shown in Table 1.

Formula (XIX)

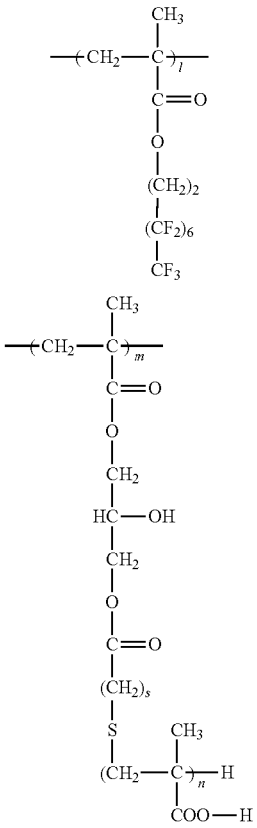

Example 11

An electrophotographic photoreceptor is obtained in a similar manner to Example 10, except that the coating liquid for forming a charge transport layer is prepared in which the amount of the bisphenol Z-type polycarbonate resin (viscosity average molecular weight: 40,000) in liquid A is changed to 0.075% by weight (15% by weight with respect to tetrafluoroethylene resin particles). The obtained electrophotographic photoreceptor is evaluated in a similar manner to Example 1. The obtained results are shown in Table 1.

Example 12

An electrophotographic photoreceptor is obtained in a similar manner to Example 10, except that the coating liquid for forming a charge transport layer is prepared in which the bisphenol Z-type polycarbonate resin (viscosity average molecular weight 40,000) is not added to liquid A The obtained electrophotographic photoreceptor is evaluated in a similar manner to Example 1. The obtained results are shown in Table 1.

Comparative Example 11

An electrophotographic photoreceptor is obtained in a similar manner to Example 1, except that the tetrafluoroethylene resin particles are not used in the coating liquid for forming a charge transport layer. The obtained electrophotographic photoreceptor is evaluated in a similar manner to Example 1. The obtained results are shown in Tables 1A and 1B.

TABLE 1A

| | First Test Print | | | | | | |
|---|---|---|---|---|---|---|---|
| | Blank (Generation of Black Spots) | Halftone | One Dot Line Reproducibility | ΔVL/V | ΔRp/V | Ratio of Wear/Cycle | Occurrence of Blade Bending |
| Example 1 | Not generated | Good | Good | 10 V or Less | 5 | 34 | No |
| Example 2 | Slightly generated | Good | Fading occurred | 10 V or Less | 8 | 36 | No |
| Example 3 | Not generated | Good | Good | 10 V or Less | 11 | 32 | No |
| Example 4 | Not generated | Good | Good | 10 V or Less | 12 | 38 | No |
| Example 5 | Not generated | Good | Good | 10 V or Less | 7 | 35 | No |
| Example 6 | Not generated | Good | Good | 10 V or Less | 8 | 29 | No |
| Comparative Example 1 | Generated | Good | Good | 35 V | 73 | 68 | No |
| Comparative Example 2 | Generated | White spots occurred | Fading occurred | 20 V | 35 | 59 | Yes |
| Example 7 | Slightly generated | White spots occurred | Fading occurred | 10 V or Less | 40 | 33 | No |
| Example 8 | Slightly generated | Good | Good | 10 V or Less | 91 | 35 | No |
| Example 9 | Slightly generated | Good | Good | 10 V or Less | 9 | 37 | Yes |
| Comparative Example 3 | Slightly generated | Good | Fading occurred | 10 V or Less | 11 | 55 | Yes |
| Comparative Example 4 | Slightly generated | Good | Fading occurred | 10 V or Less | 6 | 60 | Yes |

TABLE 1B

| | First Test Print | | | | | | |
|---|---|---|---|---|---|---|---|
| | Blank (Generation of Black Spots) | Halftone | One Dot Line Reproducibility | ΔVL/V | ΔRp/V | Ratio of Wear/Cycle | Occurrence of Blade Bending |
| Comparative Example 5 | Slightly generated | Good | Fading occurred | 10 V or Less | 12 | 45 | Yes |
| Comparative Example 6 | Slightly generated | Good | Fading occurred | 10 V or Less | 14 | 70 | Yes |
| Comparative Example 7 | Slightly generated | Good | Fading occurred | 10 V or Less | 12 | 65 | Yes |
| Comparative Example 8 | Slightly generated | Good | Fading occurred | 10 V or Less | 10 | 50 | Yes |
| Comparative Example 9 | Slightly generated | Density Unevenness occurred | Fading occurred | 24 V | 73 | 80 | Yes |
| Comparative Example 10 | Slightly generated | White Spots occurred | Fading occurred | 10 V or Less | 32 | 75 | Yes |
| Example 10 | Not generated | Good | Good | 10 V or Less | 5 | 35 | No |
| Example 11 | Not generated | Good | Good | 10 V or Less | 7 | 37 | No |
| Example 12 | Not generated | Good | Good | 10 V or Less | 55 | 36 | No |
| Comparative Example 11 | Not generated | Good | Good | 10 V or Less | 5 | 100 | No |

As can be seen from the results of Table 1, the electrophotographic photoreceptor obtained by using the material for an electrophotographic photoreceptor and the coating liquid for an electrophotographic photoreceptor of the present invention may exhibit suppressed occurrence of coating defects, improved thin line reproducibility, suppressed occurrence of bending of the edge of a cleaning blade, reduced wear ratio, and improved maintainability of electric characteristics at the time of continuous use.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising at least a photosensitive layer on an electroconductive substrate, a surface layer of the electrophotographic photoreceptor including (i) a fluorinated alkyl group-containing copolymer consisting of repeating units represented by the following Formulae A and B, and (ii) fluorine-based resin particles:

Formula A

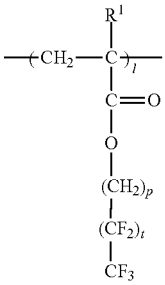

Formula B

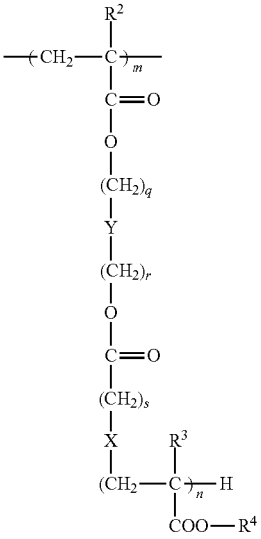

wherein in Formulae A and B, l, m and n each independently represent a integer number of 1 or more;

p, q, r and s each independently represent 0 or an integer of 1 or more;

t represents an integer of from 1 to 3;

R1, R2, R3, and R4 each independently represent a hydrogen atom or an alkyl group;

X represents an alkylene chain, a halogen-substituted alkylene chain, —S—, —O—, —NH —or a single bond;

Y represents an alkylene chain, a halogen-substituted alkylene chain, —($C_zH_{2z-1}$ (OH))—or a single bond; and z represents an integer of 1 or more.

2. The electrophotographic photoreceptor according to claim 1, wherein the weight average molecular weight of the fluorinated alkyl group-containing copolymer is from about 10,000 to about 100,000.

3. The electrophotographic photoreceptor according to claim 1, wherein the fluorine-based resin particles contain a tetrafluoroethylene resin.

4. The electrophotographic photoreceptor according to claim 1, wherein the content of the fluorine-based resin particles in the surface layer is from about 1% by volume to about 15% by volume.

5. The electrophotographic photoreceptor according to claim 1, wherein the content of the fluorinated alkyl group-containing copolymer in the surface layer with respect to the content of the fluorine-based resin particles in the surface layer is from about 1% by weight to about 5% by weight.

6. The electrophotographic photoreceptor according to claim 1, wherein the surface layer further contains a fluorine-modified silicone oil represented by the following Formula 1:

Formula 1

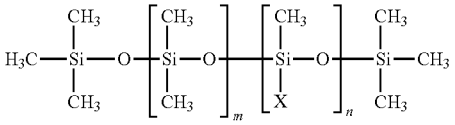

wherein in Formula 1, m and n each independently represent an integer of 1 or more, and X represents a group containing a fluorine atom.

7. The electrophotographic photoreceptor according to claim 6, wherein X in Formula 1 represents a fluoroalkyl group having 1 to 10 carbon atoms.

8. The electrophotographic photoreceptor according to claim 6, wherein the content of the fluorine-modified silicone oil in the surface layer is from about 0.1 ppm to about 1,000 ppm.

9. The electrophotographic photoreceptor according to claim 1, wherein the surface layer further contains a siloxane compound containing repeating units represented by the following Formulae D and E:

Formula D

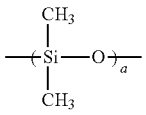

Formula E

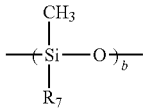

wherein in Formulae D and E, $R_7$ represents an alkyl group having 2 or more carbon atoms, and a and b each independently represent an integer of 1 or more.

10. The electrophotographic photoreceptor according to claim 9, wherein the alkyl group represented by $R_7$ in Formula E has 8 or more carbon atoms.

11. The electrophotographic photoreceptor according to claim 9, wherein the content of the siloxane compound in the surface layer is from about 5 ppm to about 1,000 ppm.

12. The electrophotographic photoreceptor according to claim 1, wherein the photosensitive layer comprises a charge generation layer and a charge transport layer in this order from the electroconductive substrate side, and wherein the charge transport layer is the surface layer.

13. An image forming apparatus comprising:

the electrophotographic photoreceptor according to claim 1;

a charging unit that charges a surface of the electrophotographic photoreceptor;

an electrostatic latent image forming unit that forms an electrostatic latent image on the surface of the charged electrophotographic photoreceptor;

an image forming unit that forms a toner image by developing the electrostatic latent image formed on the surface of the electrophotographic photoreceptor with a developer; and a transfer unit that transfers the toner image formed on the surface of the electrophotographic photoreceptor onto a surface of an image receiving body.

14. The image forming apparatus according to claim 13, further comprising a cleaning unit that removes the remaining toner from the surface of the electrophotographic photoreceptor after the transfer.

15. The image forming apparatus according to claim 14, wherein the cleaning unit comprises a cleaning blade.

16. A process cartridge that is detachably attachable to an image forming apparatus main body, the process cartridge comprising:

the electrophotographic photoreceptor according to claim 1; and at least one selected from the group consisting of a charging unit that charges a surface of the electrophotographic photoreceptor, an electrostatic latent image forming unit that forms an electrostatic latent image on the surface of the charged electrophotographic photoreceptor, an image forming unit that forms a toner image by developing the electrostatic latent image formed on the surface of the electrophotographic photoreceptor with a developer, a transfer unit that transfers the toner image formed on the surface of the electrophotographic photoreceptor onto a surface of an image receiving body, and a cleaning unit that removes the remaining toner from the surface of the electrophotographic photoreceptor after the transfer.

17. The electrophotographic photoreceptor according to claim 1, wherein t represents an integer of 1 or 2.

* * * * *